US010316710B2

(12) United States Patent
Hashimoto

(10) Patent No.: US 10,316,710 B2
(45) Date of Patent: Jun. 11, 2019

(54) OIL SUPPLY CONTROL DEVICE OF ENGINE

(71) Applicant: MAZDA MOTOR CORPORATION, Hiroshima (JP)

(72) Inventor: Masanori Hashimoto, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/759,962

(22) PCT Filed: Feb. 7, 2017

(86) PCT No.: PCT/JP2017/004397
§ 371 (c)(1),
(2) Date: Mar. 14, 2018

(87) PCT Pub. No.: WO2017/145741
PCT Pub. Date: Aug. 31, 2017

(65) Prior Publication Data

US 2018/0258802 A1 Sep. 13, 2018

(30) Foreign Application Priority Data

Feb. 23, 2016 (JP) ..... 2016-032348

(51) Int. Cl.
*F01L 13/00* (2006.01)
*F01L 1/344* (2006.01)
(Continued)

(52) U.S. Cl.
CPC ..... *F01L 13/0005* (2013.01); *F01L 1/047* (2013.01); *F01L 1/18* (2013.01); *F01L 1/344* (2013.01);
(Continued)

(58) Field of Classification Search
CPC ..... F01L 1/047; F01L 1/18; F01L 13/0005; F02D 13/0253
(Continued)

(56) References Cited

U.S. PATENT DOCUMENTS

2009/0217740 A1* 9/2009 Nedachi ..... F01M 11/10 73/54.01
2016/0010519 A1 1/2016 Hashimoto et al.

FOREIGN PATENT DOCUMENTS

JP 2009-127580 A 6/2009
JP 2009-203916 A 9/2009
(Continued)

OTHER PUBLICATIONS

International Search Report issued in PCT/JP2017/004397; dated Apr. 18, 2017.

*Primary Examiner* — Jorge L Leon, Jr.
(74) *Attorney, Agent, or Firm* — Studebaker & Brackett PC

(57) ABSTRACT

An oil supply control device includes: an adjusting device which adjusts an oil discharge amount according to an input control value to adjust a hydraulic pressure; a hydraulic controller which outputs the control value to the adjusting device; a memory which stores a first initial control value corresponding to a first target hydraulic pressure at which a hydraulic actuating device is not activated, and a second initial control value corresponding to a second target hydraulic pressure at which the hydraulic actuating device is activated; and a determination portion which compares oil initial characteristics represented by the first and second initial control values with oil characteristics represented by first and second control values, to perform oil determination as to whether or not a viscosity of the oil has changed, the first control value being input before increase of the hydrau-
(Continued)

lic pressure, the second control value being input after increase.

6 Claims, 30 Drawing Sheets

(51) Int. Cl.
*F01L 1/047* (2006.01)
*F01L 1/18* (2006.01)
*F02D 13/02* (2006.01)
*F02D 13/06* (2006.01)

(52) U.S. Cl.
CPC ..... *F01L 1/3442* (2013.01); *F02D 13/0253* (2013.01); *F02D 13/06* (2013.01)

(58) Field of Classification Search
USPC ..... 123/90.12, 90.27, 90.44
See application file for complete search history.

(56) References Cited

FOREIGN PATENT DOCUMENTS

| | | | |
|---|---|---|---|
| JP | 2010-071112 | A | 4/2010 |
| JP | 5034898 | B2 | 9/2012 |
| JP | 2014-199011 | A | 10/2014 |

* cited by examiner

FIG. 8

| OPERATING STATE | ROTATIONAL SPEED | LOAD | OIL TEMPERATURE | 1000 | 1200 | ··· | 2000 | ··· | 3000 | ··· | 4000 |
|---|---|---|---|---|---|---|---|---|---|---|---|
| — | — | — | Ta1 | Pa11 | Pa21 | ··· | Pa31 | ··· | Pa41 | ··· | Pa51 |
| | | | Ta2 | Pa12 | Pa22 | ··· | Pa32 | ··· | Pa42 | ··· | Pa52 |
| | | | Ta3 | Pa13 | Pa23 | ··· | Pa33 | ··· | Pa43 | ··· | Pa53 |

(kPa)

FIG. 9

| OPERATING STATE | ROTATIONAL SPEED | LOAD | OIL TEMPERATURE | — |
|---|---|---|---|---|
| PERFORM CYLINDER DEACTIVATION | — | — | — | P1 |
| RETAIN CYLINDER DEACTIVATION | — | — | — | P2 |

(kPa)

FIG. 10

| OPERATING STATE | ROTATIONAL SPEED | LOAD | OIL TEMPERATURE | — |
|---|---|---|---|---|
| — | — | NOT SMALLER THAN LP1 | — | P3 |
| — | NOT SMALLER THAN Va1 | NOT SMALLER THAN LP2 | | |
| — | NOT SMALLER THAN Va2 | — | | |
| CYLINDER DEACTIVATION | — | NOT SMALLER THAN LP3 | | |
| CYLINDER DEACTIVATION | NOT SMALLER THAN Va3 | NOT SMALLER THAN LP4 | | |

(kPa)

FIG. 11

| OPERATING STATE | ROTATIONAL SPEED | LOAD | OIL TEMPERATURE | 1000 | 1200 | ··· | 2000 | ··· | 3000 | ··· | 4000 |
|---|---|---|---|---|---|---|---|---|---|---|---|
| — | — | — | Tc1 | Pc11 | Pc21 | ··· | Pc31 | ··· | Pc41 | ··· | Pc51 |
| | | | Tc2 | Pc12 | Pc22 | ··· | Pc32 | ··· | Pc42 | ··· | Pc52 |
| | | | Tc3 | Pc13 | Pc23 | ··· | Pc33 | ··· | Pc43 | ··· | Pc53 |

(kPa)

FIG. 13

1300

| OIL TEMPERATURE [°C] | ENGINE ROTATIONAL SPEED [rpm] | | | | | | | | | | | | | | | |
|---|---|---|---|---|---|---|---|---|---|---|---|---|---|---|---|---|
| | 1000 | 1200 | 1400 | 1600 | 1800 | 2000 | 2200 | 2400 | 2600 | 2800 | 3000 | 3200 | 3400 | 3600 | 3800 | 4000 |
| ... | | | | | | | | | | | | | | | | |
| 0 | | | | | | | | | | | | | | | | |
| 5 | | | | | | | | | | | | | | | | |
| 10 | | | | | | | | | | | | | | | | |
| 15 | | | | | | | | | | | | | | | | |
| 20 | | | | | | | | | | | | | | | | |
| 25 | | | | | | | | | | | | | | | | |
| 30 | | | | | | | | | | | | | | | | |
| 35 | | | | | | | | | | | | | | | | |
| 40 | | | | | | | | | | | | | | | | |
| 45 | | | | | | | | | | | | | | | | |
| 50 | | | | | | | | | | | | | | | | |
| 55 | | | | | | | | | | | | | | | | |
| 60 | | | | | | | | | | | | | | | | |
| ... | | | | | | | | | | | | | | | | |

(%)

FIG. 14

1400

| OIL TEMPERATURE [°C] | ENGINE ROTATIONAL SPEED [rpm] | | | | | | | | | | | | | | | |
|---|---|---|---|---|---|---|---|---|---|---|---|---|---|---|---|---|
| | 1000 | 1200 | 1400 | 1600 | 1800 | 2000 | 2200 | 2400 | 2600 | 2800 | 3000 | 3200 | 3400 | 3600 | 3800 | 4000 |
| ... | | | | | | | | | | | | | | | | |
| 0 | | | | | | | | | | | | | | | | |
| 5 | | | | | | | | | | | | | | | | |
| 10 | | | | | | | | | | | | | | | | |
| 15 | | | | | | | | | | | | | | | | |
| 20 | | | | | | | | | | | | | | | | |
| 25 | | | | | | | | | | | | | | | | |
| 30 | | | | | | | | | | | | | | | | |
| 35 | | | | | | | | | | | | | | | | |
| 40 | | | | | | | | | | | | | | | | |
| 45 | | | | | | | | | | | | | | | | |
| 50 | | | | | | | | | | | | | | | | |
| 55 | | | | | | | | | | | | | | | | |
| 60 | | | | | | | | | | | | | | | | |
| ... | | | | | | | | | | | | | | | | |

(%)

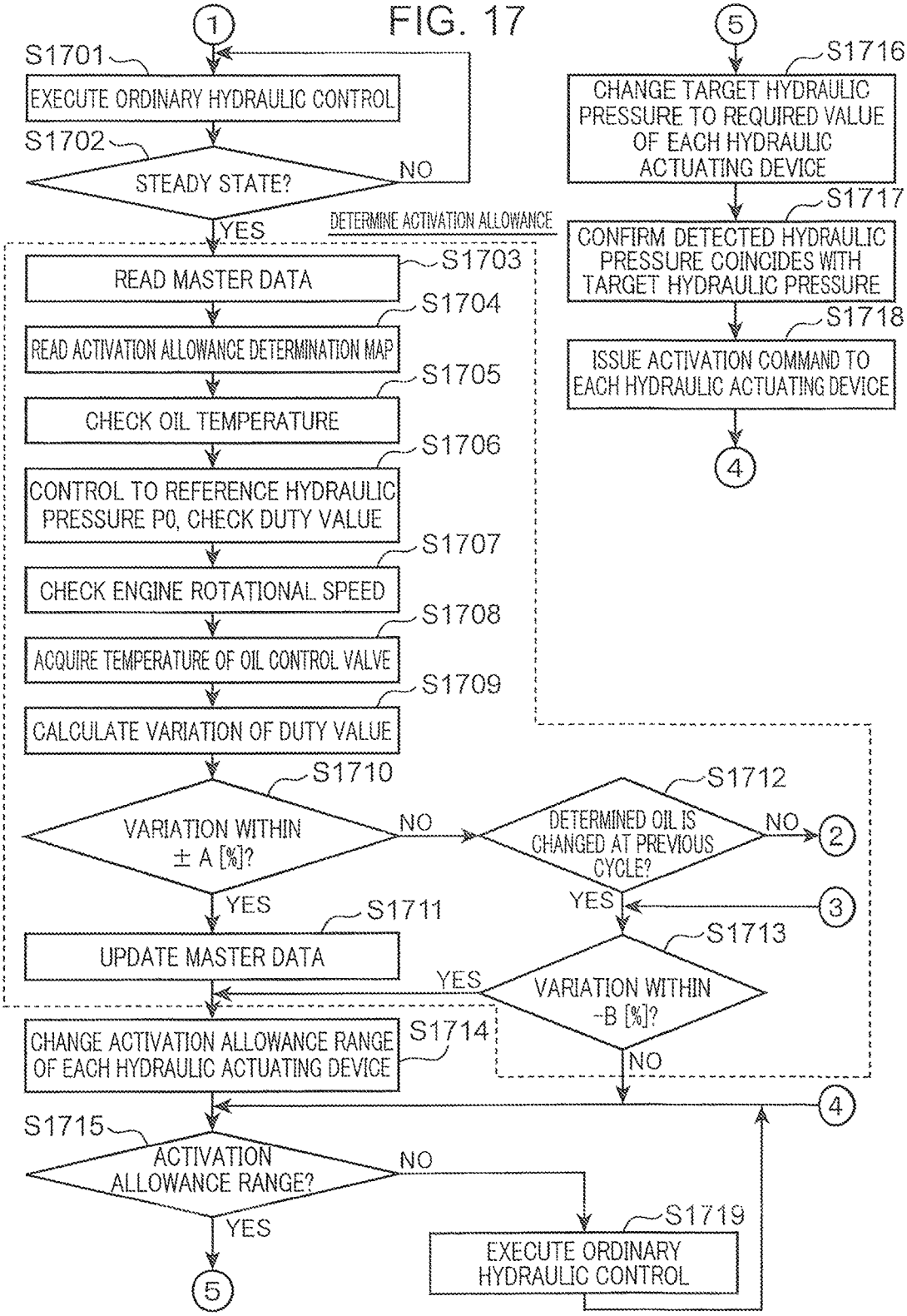
FIG. 17
1
S1701
EXECUTE ORDINARY HYDRAULIC CONTROL
S1702
STEADY STATE?
NO
YES
DETERMINE ACTIVATION ALLOWANCE
S1703
READ MASTER DATA
S1704
READ ACTIVATION ALLOWANCE DETERMINATION MAP
S1705
CHECK OIL TEMPERATURE
S1706
CONTROL TO REFERENCE HYDRAULIC PRESSURE P0, CHECK DUTY VALUE
S1707
CHECK ENGINE ROTATIONAL SPEED
S1708
ACQUIRE TEMPERATURE OF OIL CONTROL VALVE
S1709
CALCULATE VARIATION OF DUTY VALUE
S1710
VARIATION WITHIN ± A [%]?
NO
YES
S1712
DETERMINED OIL IS CHANGED AT PREVIOUS CYCLE?
NO
2
YES
3
S1711
UPDATE MASTER DATA
S1713
VARIATION WITHIN -B [%]?
YES
NO
S1714
CHANGE ACTIVATION ALLOWANCE RANGE OF EACH HYDRAULIC ACTUATING DEVICE
4
S1715
ACTIVATION ALLOWANCE RANGE?
NO
YES
5
S1719
EXECUTE ORDINARY HYDRAULIC CONTROL
5
S1716
CHANGE TARGET HYDRAULIC PRESSURE TO REQUIRED VALUE OF EACH HYDRAULIC ACTUATING DEVICE
S1717
CONFIRM DETECTED HYDRAULIC PRESSURE COINCIDES WITH TARGET HYDRAULIC PRESSURE
S1718
ISSUE ACTIVATION COMMAND TO EACH HYDRAULIC ACTUATING DEVICE
4

FIG. 21

2100

| OIL TEMPERATURE [°C] | HYDRAULIC PRESSURE [kPa] | | |
|---|---|---|---|
| | P0 | P2 | P1 |
| Tp0 | ••• | ••• | ••• |
| ••• | ••• | ••• | ••• |
| 35 | Dt035 | Dt235 | Dt135 |
| 40 | Dt040 | Dt240 | Dt140 |
| 45 | Dt045 | Dt245 | Dt145 |
| ••• | ••• | ••• | ••• |

(%)

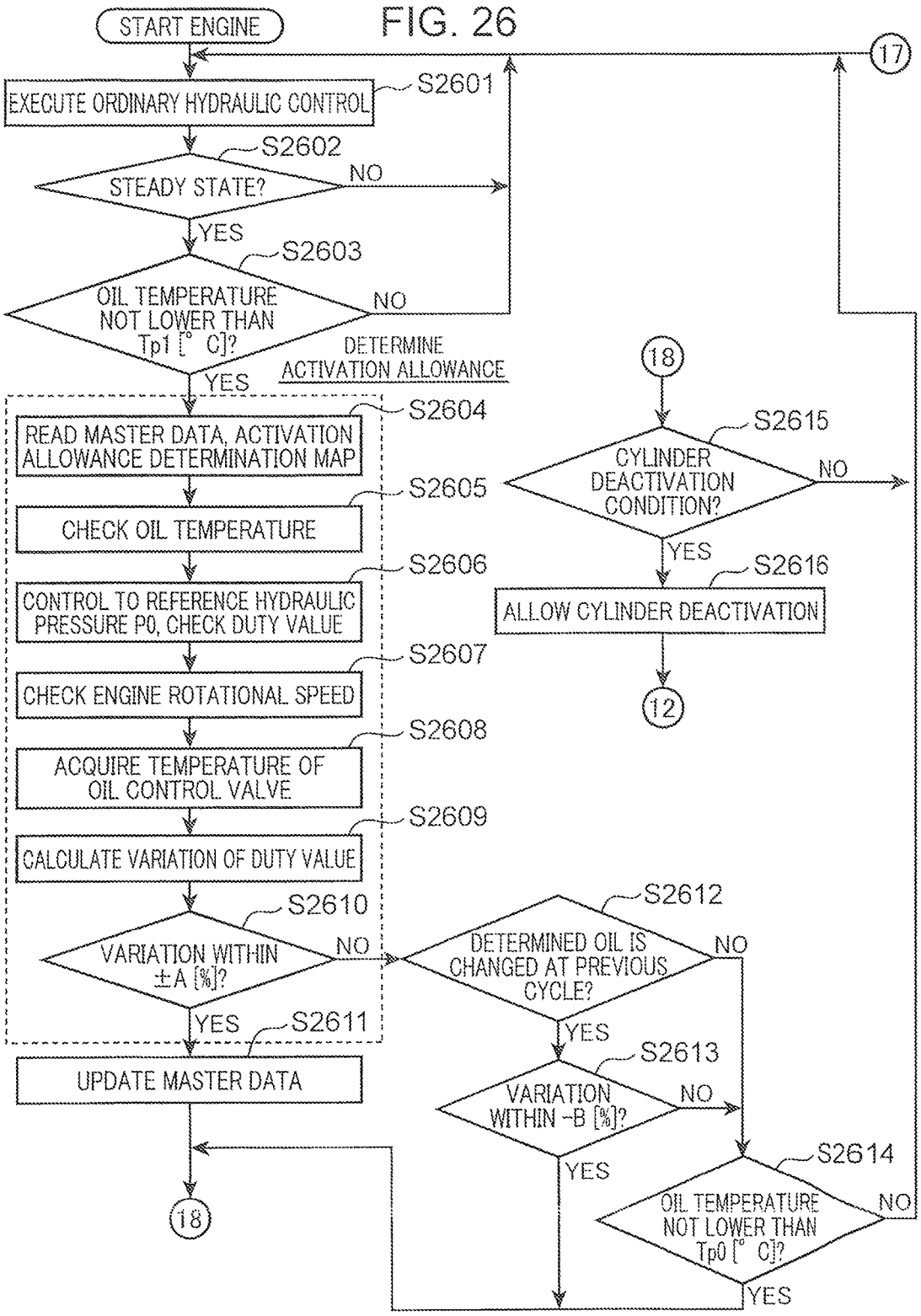
FIG. 26
START ENGINE
EXECUTE ORDINARY HYDRAULIC CONTROL
S2601
S2602
STEADY STATE?
NO
YES
S2603
OIL TEMPERATURE NOT LOWER THAN Tp1 [° C]?
NO
YES
DETERMINE ACTIVATION ALLOWANCE
S2604
READ MASTER DATA, ACTIVATION ALLOWANCE DETERMINATION MAP
S2605
CHECK OIL TEMPERATURE
S2606
CONTROL TO REFERENCE HYDRAULIC PRESSURE P0, CHECK DUTY VALUE
S2607
CHECK ENGINE ROTATIONAL SPEED
S2608
ACQUIRE TEMPERATURE OF OIL CONTROL VALVE
S2609
CALCULATE VARIATION OF DUTY VALUE
S2610
VARIATION WITHIN ±A [%]?
NO
YES
S2611
UPDATE MASTER DATA
18
17
18
S2615
CYLINDER DEACTIVATION CONDITION?
NO
YES
S2616
ALLOW CYLINDER DEACTIVATION
12
S2612
DETERMINED OIL IS CHANGED AT PREVIOUS CYCLE?
NO
YES
S2613
VARIATION WITHIN −B [%]?
NO
YES
S2614
OIL TEMPERATURE NOT LOWER THAN Tp0 [° C]?
NO
YES

OIL SUPPLY CONTROL DEVICE OF ENGINE

TECHNICAL FIELD

A technique disclosed herein relates to an oil supply control device for an engine, which controls oil supply to an engine for driving a vehicle.

BACKGROUND ART

Conventionally, there is known an oil supply control device for controlling oil supply to each part of an engine. For example, Patent Literature 1 discloses a technique, in which viscosity characteristics of oil are specified from a response speed and an oil temperature when a hydraulic operation of a hydraulically operated variable valve timing mechanism is started, a learning value of viscosity characteristics stored in a storage unit is updated based on the viscosity characteristics, and the learning value of viscosity characteristics is reflected to control of the hydraulically operated variable valve timing mechanism for accurate operation control.

Further, Patent Literature 2 discloses a technique, in which a plurality of hydraulic actuating devices such as a hydraulically operated variable valve timing mechanism and a valve stopping device are provided, and a discharge amount of a capacity variable oil pump is controlled to a target hydraulic pressure at which a hydraulic actuating device is activated depending on an operating state of an engine with use of a regulator valve.

CITATION LIST

Patent Literature

Patent Literature 1: Japanese Patent No. 5034898

Patent Literature 2: Japanese Unexamined Patent Publication No. 2014-199011

SUMMARY OF INVENTION

In Patent Literature 1, viscosity characteristics of oil greatly change when oil is changed to oil of another type having different viscosity characteristics at the time of oil exchange. Therefore, it may be difficult to appropriately control a hydraulically operated variable valve timing mechanism only by updating a learning value of viscosity characteristics, which is performed heretofore. Thus, it is desired to determine whether or not a viscosity of oil has changed.

Further, in Patent Literature 2, a discharge amount of a capacity variable oil pump is controlled to a target hydraulic pressure at which a hydraulic actuating device is activated depending on an operating state of an engine with use of a regulator valve. Therefore, it is possible to attain a target hydraulic pressure even when oil is changed to oil of another type having different viscosity characteristics at the time of oil exchange. However, a viscosity resistance of oil may affect an operation speed of each of the hydraulic actuating devices. Thus, it is also desired to determine whether or not a viscosity of oil has changed.

The present invention is made in order to overcome the aforementioned drawbacks, and an object thereof is to provide an oil supply control device for an engine, which enables to determine whether or not a viscosity of oil has changed when oil is changed to oil of another type at the time of oil exchange, for example.

An aspect of the present invention includes: an oil pump of which an oil discharge amount is variable; a hydraulic actuating device which is activated in response to a pressure of oil supplied from the oil pump; a hydraulic pressure sensor which is disposed in an oil supply passage connecting the oil pump and the hydraulic actuating device, and detects a hydraulic pressure; an adjusting device which adjusts the oil discharge amount from the oil pump according to an input control value to adjust the hydraulic pressure; a hydraulic controller which outputs the control value to the adjusting device to cause a detected hydraulic pressure detected by the hydraulic pressure sensor to coincide with a target hydraulic pressure depending on an operating state of the engine; a memory which stores in advance a first initial control value and a second initial control value as initial values of the control value corresponding to the target hydraulic pressure; the first initial control value corresponding to a first target hydraulic pressure at which the hydraulic actuating device is not activated, the second initial control value corresponding to a second target hydraulic pressure at which the hydraulic actuating device is activated; and a determination portion which compares oil initial characteristics represented by the first initial control value and the second initial control value stored in advance in the memory with oil characteristics represented by a first control value and a second control value, to perform oil determination as to whether or not a viscosity of the oil has changed, the first control value being a value which is input, when the detected hydraulic pressure is increased from the first target hydraulic pressure to the second target hydraulic pressure, from the hydraulic controller to the adjusting device before increase of the hydraulic pressure, the second control value being a value which is input from the hydraulic controller to the adjusting device after increase of the hydraulic pressure.

According to the present invention, the initial oil characteristics represented by the first initial control value and the second initial control value, and the oil characteristics represented by the first control value and the second control value are compared, to perform oil determination as to whether or not a viscosity of the oil has changed. Therefore, it is possible to determine whether or not a viscosity of oil has changed within a period of time from a point of time when the first initial control value and the second initial control value are acquired until a point of time when the first control value and the second control value are acquired.

BRIEF DESCRIPTION OF DRAWINGS

FIG. 8 is a diagram illustrating a base hydraulic pressure map.

FIG. 9 is a diagram illustrating a required hydraulic pressure map of the valve stopping mechanism.

FIG. 10 is a diagram illustrating a required hydraulic pressure map of an oil jet.

FIG. 11 is a diagram illustrating a required hydraulic pressure map of an exhaust-side VVT mechanism.

FIG. 13 is a diagram schematically illustrating master data stored in advance in a memory of a controller.

FIG. 14 is a diagram schematically illustrating a correction coefficient map stored in advance in the memory of the controller.

FIG. 17 is a flowchart schematically illustrating an operation of the oil supply control device to be performed when the engine is started at a second time and thereafter.

FIG. 21 is a diagram schematically illustrating an example of a hardware/oil determination map stored in the memory.

FIG. 26 is a flowchart schematically illustrating an operation of the oil supply control device to be performed when the engine is started at a second time and thereafter.

DESCRIPTION OF EMBODIMENTS

Figure 1:
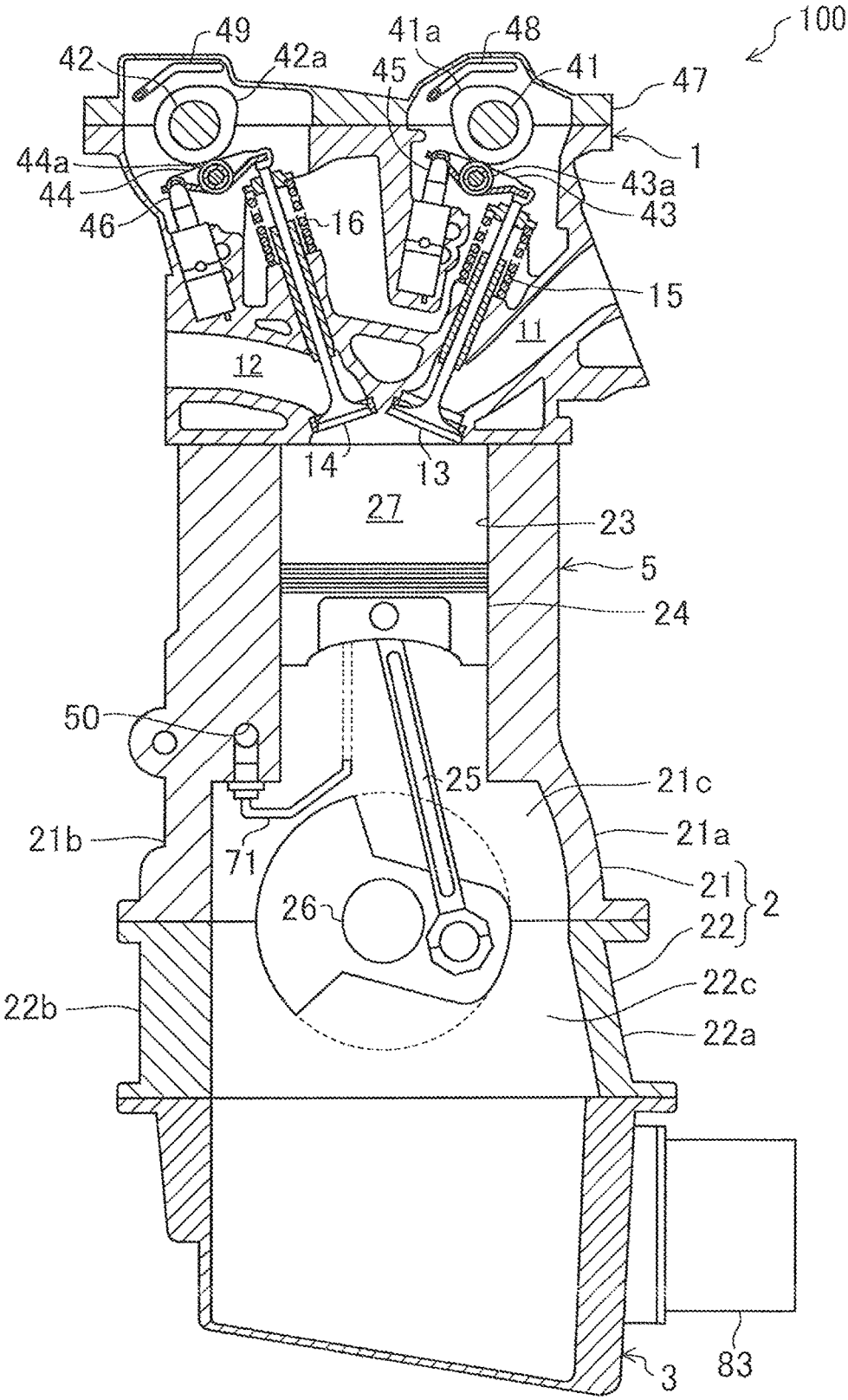
FIG. 1 is a schematic sectional view of an engine taken along a plane including an axis of a cylinder.

In the following, an embodiment of the present disclosure is described in detail with reference to the drawings. Note that in each of the drawings, same elements are indicated with same reference numerals, and repeated description thereof is omitted as necessary.

FIG. 1 is a cross-sectional view schematically illustrating an engine 100 taken along a plane including an axis of a cylinder. In the present specification, for the convenience of explanation, an axis direction of a cylinder is referred to as an up-down direction, and a cylinder array direction is referred to as a front-rear direction. Further, a side of the engine 100 opposite to a transmission in the cylinder array direction is referred to as a front side, and a transmission side is referred to as a rear side.

The engine 100 is an in-line four-cylinder engine configured such that four cylinders are aligned in a predetermined cylinder array direction. The engine 100 includes a cylinder head 1, a cylinder block 2 mounted on the cylinder head 1, and an oil pan 3 mounted on the cylinder block 2.

The cylinder block 2 includes an upper block 21 and a lower block 22. The lower block 22 is mounted on a lower surface of the upper block 21. The oil pan 3 is mounted on a lower surface of the lower block 22.

Four cylinder bores 23 corresponding to the four cylinders are formed side by side in the upper block 21 in the cylinder array direction. In FIG. 1, only one cylinder bore 23 is illustrated. The cylinder bores 23 are formed in an upper portion of the upper block 21. A lower portion of the upper block 21 defines a part of a crank chamber. A piston 24 is disposed in each of the cylinder bores 23. Each of the pistons 24 is connected to a crankshaft 26 via a connecting rod 25. A combustion chamber 27 is defined by the cylinder bore 23, the piston 24, and the cylinder head 1. Note that the four cylinder bores 23 correspond to a first cylinder, a second cylinder, a third cylinder, and a fourth cylinder in this order from the front side.

An intake port 11 and an exhaust port 12 opened to the combustion chamber 27 are formed in the cylinder head 1. An intake valve 13 for opening and closing the intake port 11 is provided in the intake port 11. An exhaust valve 14 for opening and closing the exhaust port 12 is provided in the exhaust port 12. The intake valve 13 and the exhaust valve 14 are respectively driven by cam portions 41*a* and 42*a* formed on camshafts 41 and 42.

Specifically, the intake valve 13 and the exhaust valve 14 are biased in a closing direction (in an upward direction in FIG. 1) by valve springs 15 and 16. Swing arms 43 and 44 are respectively interposed between the intake valve 13 and the cam portion 41*a*, and between the exhaust valve 14 and the cam portion 42*a*. One ends of the swing arms 43 and 44 are respectively supported by hydraulic lash adjusters (hereinafter, referred to as HLAs) 45 and 46. The swing arms 43 and 44 swing around one ends thereof supported by the HLAs 45 and 46 when cam followers 43*a* and 44*a* provided at substantially middle portions of the swing arms 43 and 44 are respectively pressed by the cam portions 41*a* and 42*a*. When the swing arms 43 and 44 swing as described above, the other ends thereof respectively move the intake valve 13 and the exhaust valve 14 in an opening direction (in a downward direction in FIG. 1) against biasing forces of the valve springs 15 and 16. The HLAs 45 and 46 automatically adjust the valve clearance to zero by a hydraulic pressure.

Note that the HLAs 45 and 46 provided in each of the first cylinder and the fourth cylinder respectively include valve stopping mechanisms for stopping operations of the intake valve 13 and the exhaust valve 14. In the following, when HLAs are distinguished one from another based on a presence or absence of a valve stopping mechanism, HLAs 45 and 46 including a valve stopping mechanism are referred to as HLAs 45*a* and 46*a*, and HLAs 45 and 46 without a valve stopping mechanism are referred to as HLAs 45*b* and 46*b*. The engine 100 activates all the intake valves 13 and the exhaust valves 14 of the first to fourth cylinders in an all-cylinder operation mode. On the other hand, the engine 100 deactivates the intake valves 13 and the exhaust valves 14 of the first cylinder and the fourth cylinder, and activates the intake valves 13 and the exhaust valves 14 of the second cylinder and the third cylinder in a reduced-cylinder operation mode.

Mounting holes for mounting the HLAs 45*a* and 46*a* are formed in portions of the cylinder head 1 at positions corresponding to the first cylinder and the fourth cylinder. The HLAs 45*a* and 46*a* are mounted in the mounting holes. An oil supply passage communicating with the mounting holes is formed in the cylinder head 1. Oil is supplied to the HLAs 45*a* and 46*a* through the oil supply passage.

A cam cap 47 is mounted on a top portion of the cylinder head 1. The camshafts 41 and 42 are rotatably supported by the cylinder head 1 and the cam cap 47.

An intake-side oil shower 48 is provided above the intake-side camshaft 41, and an exhaust-side oil shower 49 is provided above the exhaust-side camshaft 42. The intake-side oil shower 48 and the exhaust-side oil shower 49 are respectively configured such that oil drops onto contact portions between the cam portions 41*a* and 42*a*, and the cam followers 43*a* and 44*a* of the swing arms 43 and 44.

Further, the engine 100 includes a variable valve timing mechanism (hereinafter, referred to as a VVT mechanism) for changing valve characteristics of each of the intake valve 13 and the exhaust valve 14. An intake-side VVT mechanism is electrically operated, and an exhaust-side VVT mechanism 18 (FIG. 4 to be described later) is hydraulically operated.

The upper block 21 includes a first side wall 21*a* located on an intake side with respect to the four cylinder bores 23, a second side wall 21*b* located on an exhaust side with respect to the four cylinder bores 23, a front wall (not illustrated) located on a front side than the frontmost cylinder bore 23, a rear wall (not illustrated) located on a rear side than the rearmost cylinder bore 23, and a plurality of vertical walls 21*c* extending in an up-down direction in a portion between each two adjacent cylinder bores 23.

The lower block 22 includes a first side wall 22*a* corresponding to the first side wall 21*a* of the upper block 21 and located on an intake side, a second side wall 22*b* corresponding to the second side wall 21*b* of the upper block 21 and located on an exhaust side, a front wall (not illustrated) corresponding to the front wall of the upper block 21 and located on a front side, a rear wall (not illustrated) corresponding to the rear wall of the upper block 21 and located on a rear side, and a plurality of vertical walls 22*c* corresponding to the vertical walls 21*c* of the upper block 21. The upper block 21 and the lower block 22 are fastened to each other by bolts.

A bearing portion 28 (FIG. 2) for supporting the crankshaft 26 is provided between the front wall of the upper block 21 and the front wall of the lower block 22, between the rear wall of the upper block 21 and the rear wall of the lower block 22, and between the vertical walls 21*c* and the vertical walls 22*c*. In the following, the bearing portion 28 between the vertical wall 21*c* and the vertical wall 22*c* is described referring to FIG. 2.

Figure 2:
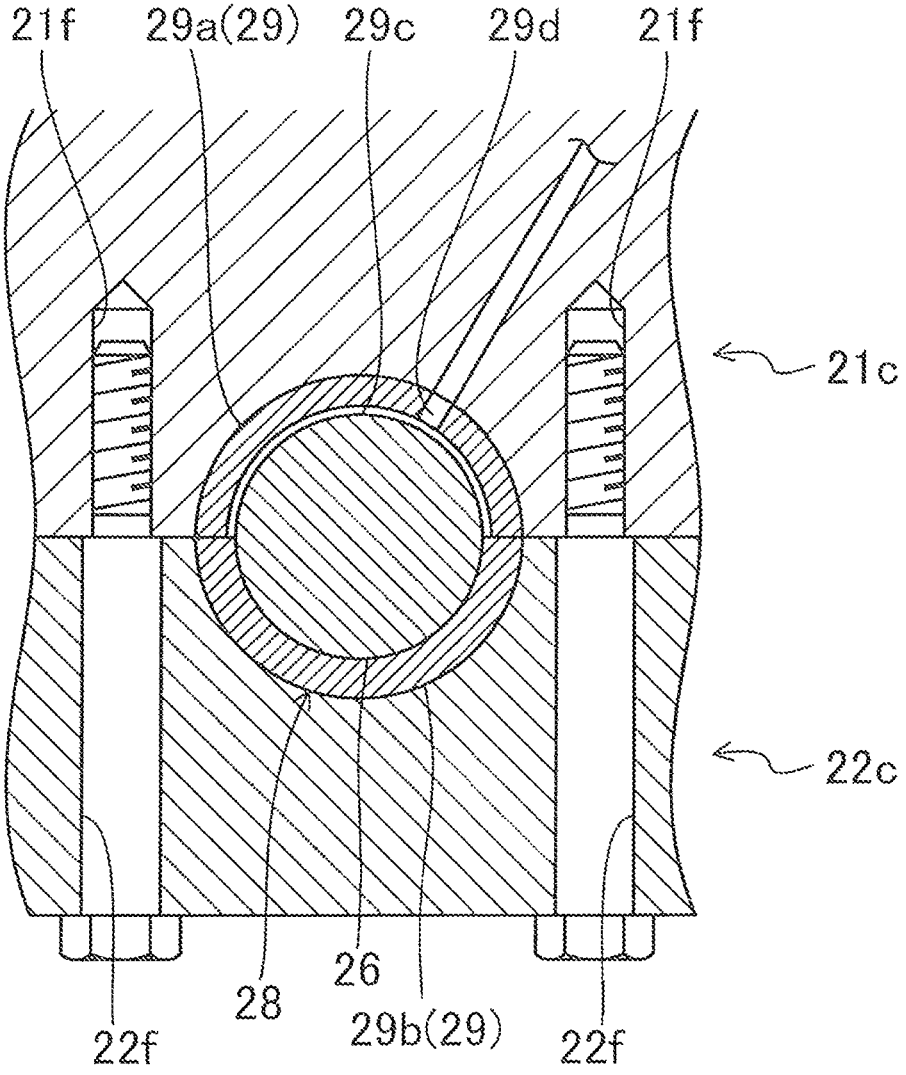
FIG. 2 is a cross-sectional view of a vertical wall of an upper block and a vertical wall of a lower block located at a middle in a cylinder array direction.

FIG. 2 is a cross-sectional view of the vertical wall 21*c* of the upper block 21, and the vertical wall 22*c* of the lower block 22 located at a middle in the cylinder array direction.

Note that the bearing portion 28 is also provided between the front wall of the upper block 21 and the front wall of the lower block 22, and between the rear wall of the upper block 21 and the rear wall of the lower block 22. When these bearing portions 28 are distinguished one from another, the bearing portions 28 are respectively referred to as a first bearing portion 28A, a second bearing portion 28B, a third bearing portion 28C, a fourth bearing portion 28D, and a fifth bearing portion 28E in this order from the front side.

The bearing portion 28 is disposed between two bolt fastening portions. Specifically, the bearing portion 28 is disposed between a pair of screw holes 21*f* and between a pair of bolt insertion holes 22*f*. The bearing portion 28 includes a tubular bearing metal 29. A semi-circular cutout portion is formed in a joint portion of each of the vertical wall 21*c* and the vertical wall 22*c*. The bearing metal 29 has a two-part structure constituted by a first semi-circular portion 29*a* and a second semi-circular portion 29*b*. The first semi-circular portion 29*a* is mounted in the cutout portion of the vertical wall 21*c*. The second semi-circular portion 29*b* is mounted in the cutout portion of the vertical wall 22*c*. By joining the vertical wall 21*c* and the vertical wall 22*c*, the first semi-circular portion 29*a* and the second semi-circular portion 29*b* are joined into a tubular shape.

An oil groove 29*c* extending in a circumferential direction is formed in an inner peripheral surface of the first semi-circular portion 29*a*. In addition to the above, a communication passage 29*d* including one end thereof opened to an outer peripheral surface of the first semi-circular portion 29*a*, and including the other end thereof opened to the oil groove 29*c* passes through the first semi-circular portion 29*a*.

An oil supply passage is formed in the upper block 21. Oil is supplied to an outer peripheral surface of the first semi-circular portion 29*a* via the oil supply passage. The communication passage 29*d* is disposed at a position where the communication passage 29*d* communicates with the oil supply passage. This configuration allows for oil supplied from the oil supply passage to flow into the oil groove 29*c* via the communication passage 29*d*.

Although the illustration is omitted, a chain cover is mounted on a front wall of the cylinder block 2. A drive sprocket mounted on the crankshaft 26, a timing chain wound around the drive sprocket, and a chain tensioner for giving a tension force to the timing chain are disposed within the chain cover.

Figure 3:
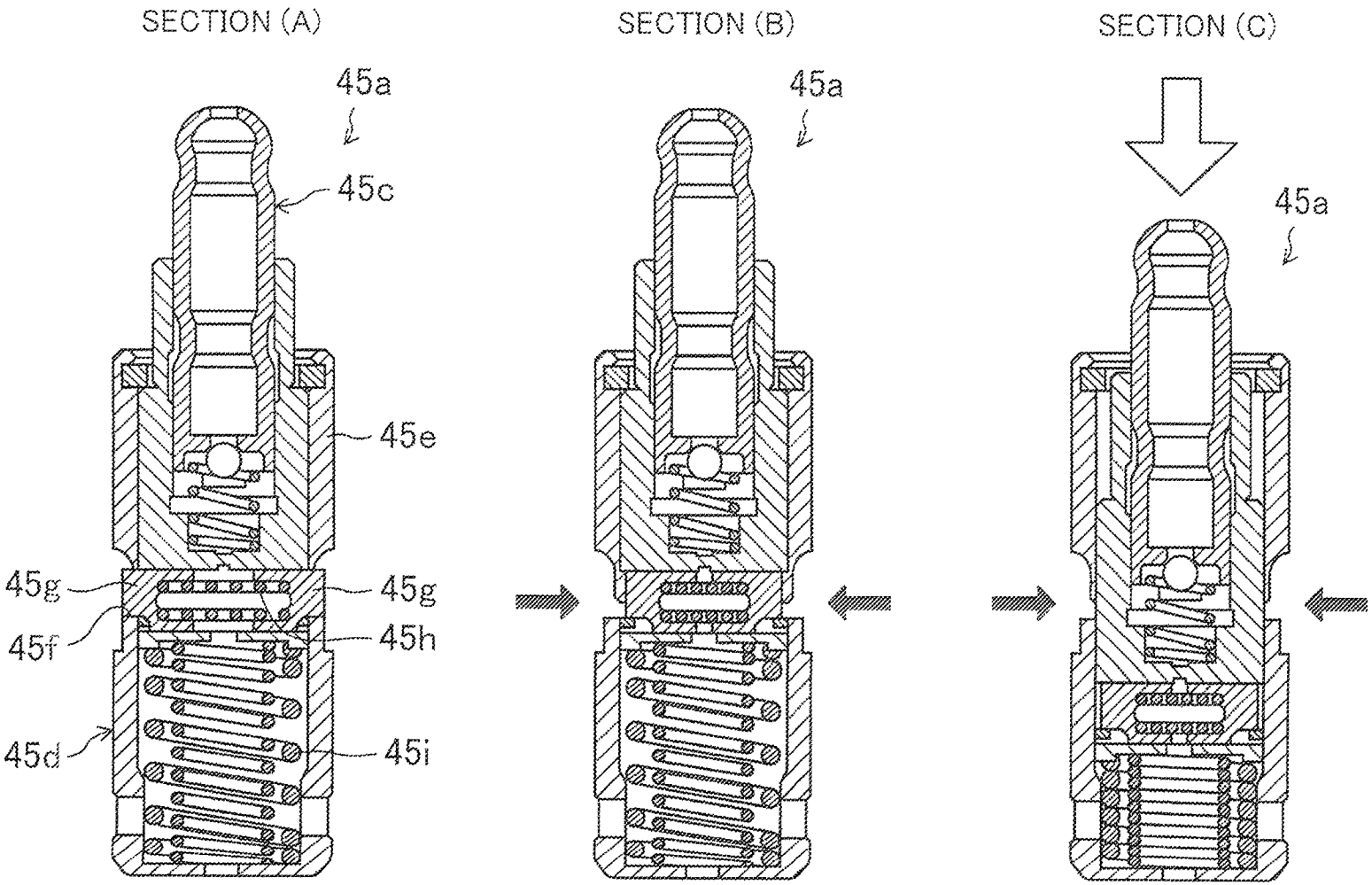
FIG. 3 is a cross-sectional view illustrating a configuration and activation of a hydraulic lash adjuster including a valve stopping mechanism.

FIG. 3 is a cross-sectional view illustrating a configuration and activation of the HLA 45*a* including a valve stopping mechanism. The section (A) of FIG. 3 illustrates a locked state, the section (B) of FIG. 3 illustrates a lock released state, and the section (C) of FIG. 3 illustrates a state that activation of a valve is stopped. Referring to FIG. 1 and FIG. 3, the HLAs 45*a* and 46*a* including a valve stopping mechanism are described in detail. Note that configurations of the HLAs 45*a* and 46*a* are substantially the same. Therefore, in the following, only a configuration of the HLA 45*a* is described.

The HLA 45*a* including a valve stopping mechanism includes a pivot mechanism 45*c* and a valve stopping mechanism 45*d*.

The pivot mechanism 45*c* is a well-known pivot mechanism for an HLA. The pivot mechanism 45*c* automatically adjusts a valve clearance to zero by a hydraulic pressure. Although the HLAs 45*b* and 46*b* do not include a valve stopping mechanism, the HLAs 45*b* and 46*b* include a pivot mechanism substantially the same as the pivot mechanism 45*c*.

The valve stopping mechanism 45*d* is a mechanism for switching between activation and deactivation of the corresponding intake valve 13 or the corresponding exhaust valve 14. The valve stopping mechanism 45*d* includes an outer cylinder 45*e*, a pair of lock pins 45*g*, a lock spring 45*h*, and a lost motion spring 45*i*. The outer cylinder 45*e* is opened at an end thereof and has a bottom at the other end thereof. The outer cylinder 45*e* accommodates the pivot mechanism 45*c* slidably in an axial direction. The paired lock pins 45*g* are projectably and retractably received in two through-holes 45*f* formed in a lateral surface of the outer cylinder 45*e* while facing each other. The lock spring 45*h* biases one of the lock pins 45*g* radially outwardly of the outer cylinder 45*e*. The lost motion spring 45*i* is disposed between the bottom of the outer cylinder 45*e* and the pivot mechanism 45*c*, and is configured to bias the pivot mechanism 45*c* axially toward the opening of the outer cylinder 45*e*.

The lock pins 45*g* are disposed at a lower end of the pivot mechanism 45*c*. The lock pins 45*g* are driven by a hydraulic pressure, and are switched between a state that the lock pins 45*g* are engaged in the through-holes 45*f*, and a state that the lock pins 45*g* are moved radially inwardly of the outer cylinder 45*e* and engagement with the through-holes 45*f* is released.

As illustrated in the section (A) of FIG. 3, when the lock pins 45*g* are engaged in the through-holes 45*f*, the pivot mechanism 45*c* is projected from the outer cylinder 45*e* by a relatively large projection amount, and axial movement of the pivot mechanism 45*c* with respect to the outer cylinder 45*e* is restricted by the lock pins 45*g*. In other words, the pivot mechanism 45*c* is in a locked state.

In this state, a top portion of the pivot mechanism 45*c* comes into contact with one end of the swing arm 43 or one end of the swing arm 44, and functions as a pivot point of a swing operation. As a result, the swing arms 43 and 44 respectively move the intake valve 13 and the exhaust valve 14 by the other ends thereof in an opening direction against urging forces of the valve springs 15 and 16. In other words, the corresponding intake valve 13 or the corresponding exhaust valve 14 is activatable when the valve stopping mechanism 45*d* is in a locked state.

On the other hand, when a hydraulic pressure is applied to the lock pins 45*g* radially inwardly, as illustrated in the section (B) of FIG. 3, the lock pins 45*g* are moved radially inwardly of the outer cylinder 45*e* against a biasing force of the lock spring 45*h*, and engagement of the lock pins 45*g* with the through-holes 45*f* is released. As a result, locking of the pivot mechanism 45*c* is released.

Also in a lock released state as described above, the pivot mechanism 45*c* is kept in a state that the pivot mechanism 45*c* is projected from the outer cylinder 45*e* by a relatively large projection amount by a biasing force of the lost motion spring 45*i*. However, axial movement of the pivot mechanism 45*c* with respect to the outer cylinder 45*e* is not restricted, and the pivot mechanism 45*c* is movable. Further, a biasing force of the lost motion spring 45*i* is set smaller than biasing forces of the valve springs 15 and 16 for biasing the intake valve 13 and the exhaust valve 14 in a closing direction.

Therefore, when the cam followers 43*a* and 44*a* are respectively pressed by the cam portions 41*a* and 42*a* in a lock released state, top portions of the intake valve 13 and the exhaust valve 14 serve as pivot points of swing operations of the swing arms 43 and 44. As illustrated in the section (C) of FIG. 3, the swing arm 43 or 44 moves the pivot mechanism 45*c* to the bottom of the outer cylinder 45*e* against a biasing force of the lost motion spring 45*i*. In other words, the valve stopping mechanism 45*d* stops activation of the corresponding intake valve 13 or the corresponding exhaust valve 14 when the pivot mechanism 45*c* is in a lock released state.

Figure 4:
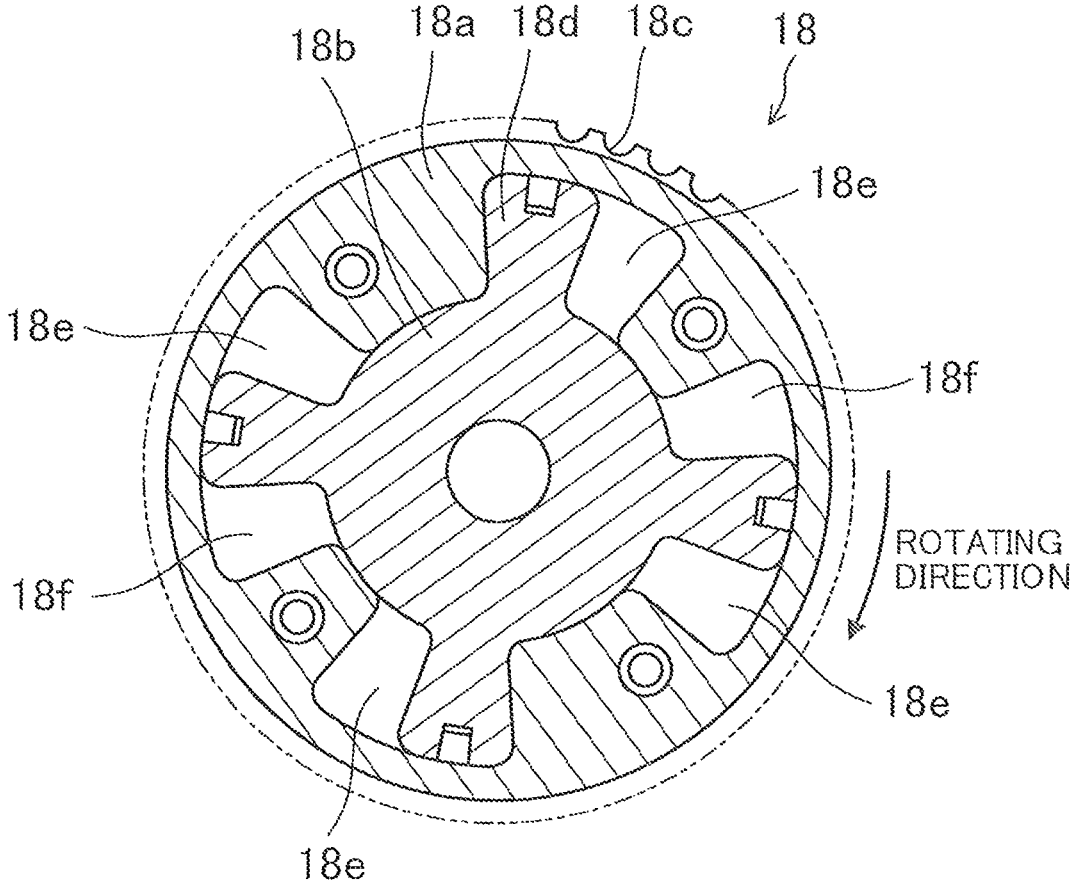
FIG. 4 is a cross-sectional view illustrating a schematic configuration of an exhaust-side variable valve timing mechanism.

FIG. 4 is a cross-sectional view illustrating a schematic configuration of the exhaust-side VVT mechanism 18. The exhaust-side VVT mechanism 18 is described in detail referring to FIG. 1 and FIG. 4.

The exhaust-side VVT mechanism 18 includes a substantially annular housing 18*a*, and a rotor 18*b* accommodated within the housing 18*a*. The housing 18*a* is integrally and rotatably connected to a cam pulley 18*c* that is rotated in synchronization with the crankshaft 26. The rotor 18*b* is integrally and rotatably connected to the camshaft 41 for opening and closing the intake valve 13. Vanes 18*d* in sliding contact with an inner peripheral surface of the housing 18*a* are formed on the rotor 18*b*. A plurality of retard angle hydraulic chambers 18*e* and a plurality of advance angle hydraulic chambers 18*f* which are defined by an inner peripheral surface of the housing 18*a*, the vanes 18*d*, and a main body of the rotor 18*b* are formed within the housing 18*a*.

Oil is supplied to the retard angle hydraulic chambers 18*e* and to the advance angle hydraulic chambers 18*f*. When a hydraulic pressure of the retard angle hydraulic chamber 18*e* is high, the rotor 18*b* is rotated in a direction opposite to a rotating direction of the housing 18*a*. Specifically, the camshaft 41 is rotated in a direction opposite to a rotating direction of the cam pulley 18*c*, and a valve opening timing of the exhaust valve 13 is retarded. On the other hand, when a hydraulic pressure of the advance angle hydraulic chamber 18*f* is high, the rotor 18*b* is rotated in a same direction as a rotating direction of the housing 18*a*. Specifically, the camshaft 41 is rotated in a same direction as a rotating direction of the cam pulley 18*c*, and a valve opening timing of the exhaust valve 14 is advanced.

Figure 5:
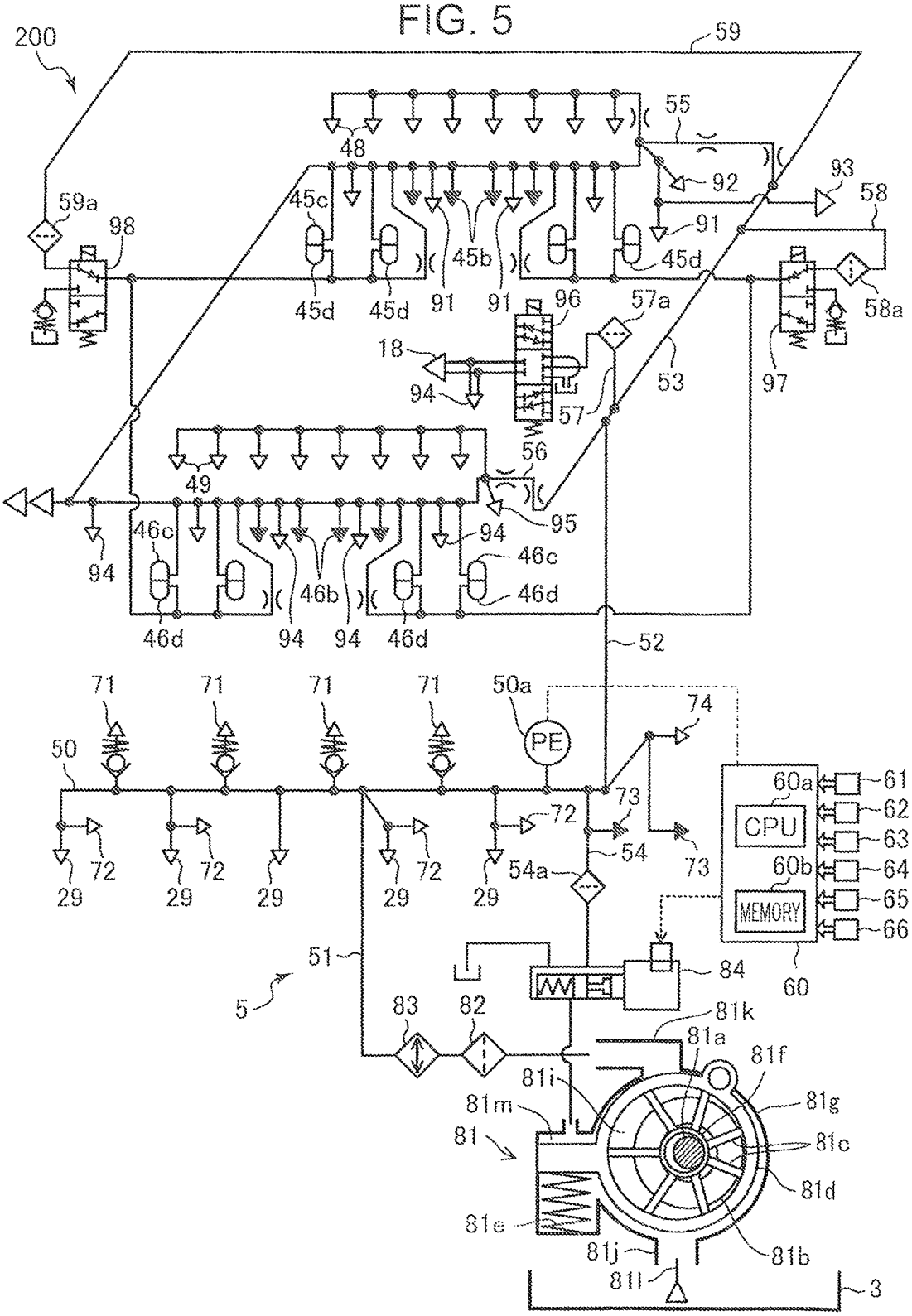
FIG. 5 is a hydraulic circuit diagram of an oil supply control device.

FIG. 5 is a hydraulic circuit diagram of an oil supply control device 200 for the engine. The oil supply control device 200 is described with reference to FIG. 1 and FIG. 5.

The oil supply control device 200 includes an oil pump 81 of a capacity variable type which is driven and rotated by the crankshaft 26, and an oil supply passage connected to the oil pump 81 and through which oil is allowed to flow. The oil pump 81 is an auxiliary component to be driven by the engine 100.

The oil pump 81 is an oil pump of a publicly known capacity variable type, and is driven by the crankshaft 26. The oil pump 81 is mounted on a lower surface of the lower block 22, and is accommodated within the oil pan 3. Specifically, the oil pump 81 includes a drive shaft 81*a*, a rotor 81*b*, a plurality of vanes 81*c*, a cam ring 81*d*, a spring 81*e*, a plurality of ring members 81*f*, and a housing 81*g*.

The drive shaft 81*a* is driven and rotated by the crankshaft 26. The rotor 81*b* is connected to the drive shaft 81*a*. The plurality of vanes 81*c* are configured to be radially projectable and retractable with respect to the rotor 81*b*. The cam ring 81*d* accommodates the rotor 81*b* and the vanes 81*c*, and is configured to adjust an eccentric amount thereof with respect to a center of rotation of the rotor 81*b*. The spring 81*e* biases the cam ring 81*d* in a direction such that the eccentric amount of the cam ring 81*d* with respect to the center of rotation of the rotor 81*b* increases. The ring member 81*f* is disposed within the rotor 81*b*. The housing 81*g* accommodates the rotor 81*b*, the vanes 81*c*, the cam ring 81*d*, the spring 81*e*, and the ring member 81*f*.

Although the illustration is omitted, one end of the drive shaft 81*a* projects outwardly of the housing 81*g*, and a driven sprocket is connected to the one end of the drive shaft

81*a*. The timing chain is wound around the driven sprocket. The timing chain is also wound around a drive sprocket of the crankshaft 26. In this way, the rotor 81*b* is driven and rotated by the crankshaft 26 via the timing chain.

When the rotor 81*b* is rotated, each of the vanes 81*c* slides on an inner peripheral surface of the cam ring 81*d*. Thus, a pump chamber (hydraulic oil chamber) 81*i* is defined by the rotor 81*b*, each two adjacent vanes 81*c*, the cam ring 81*d*, and the housing 81*g*.

A suction port 81*j* for sucking oil into the pump chamber 81*i* is formed in the housing 81*g*, and a discharge port 81*k* for discharging oil from the pump chamber 81*i* is formed in the housing 81*g*. An oil strainer 811 is connected to the suction port 81*j*. The oil strainer 811 is immersed in oil stored in the oil pan 3. In other words, oil stored in the oil pan 3 is sucked into the pump chamber 81*i* through the suction port 81*j* via the oil strainer 811. On the other hand, an oil supply passage 5 is connected to the discharge port 81*k*. In other words, oil whose pressure is increased by the oil pump 81 is discharged to the oil supply passage 5 through the discharge port 81*k*.

The cam ring 81*d* is supported on the housing 81*g* in such a manner that the cam ring 81*d* swings around a predetermined pivot point. The spring 81*e* biases the cam ring 81*d* toward one side around the pivot point. Further, a pressure chamber 81*m* is defined between the cam ring 81*d* and the housing 81*g*. The pressure chamber 81*m* is configured to receive oil from the outside. A hydraulic pressure of oil within the pressure chamber 81*m* is applied to the cam ring 81*d*. Therefore, the cam ring 81*d* swings depending on a balance between a biasing force of the spring 81*e* and a hydraulic pressure of the pressure chamber 81*m*, and the eccentric amount of the cam ring 81*d* with respect to the center of rotation of the rotor 81*b* is determined. A capacity of the oil pump 81 is changed in response to the eccentric amount of the cam ring 81*d*, and a discharge amount of oil is changed.

The oil supply passage 5 is constituted by pipes, and flow channels formed in the cylinder head 1 and in the cylinder block 2. The oil supply passage 5 includes a main gallery 50 extending in the cylinder block 2 in a cylinder array direction, a first communication passage 51 for connecting the oil pump 81 and the main gallery 50, a second communication passage 52 extending from the main gallery 50 to the cylinder head 1, a third communication passage 53 extending in the cylinder head 1 substantially horizontally between an intake side and an exhaust side of the engine 100, a control oil supply passage 54 branched from the first communication passage 51, and first to fifth oil supply passages 55 to 59 branched from the third communication passage 53.

The first communication passage 51 is connected to the discharge port 81*k* of the oil pump 81. An oil filter 82 and an oil cooler 83 are provided in this order from the oil pump 81 side within the first communication passage 51. In other words, oil discharged from the oil pump 81 to the first communication passage 51 is filtrated by the oil filter 82. After an oil temperature is adjusted by the oil cooler 83, oil is allowed to flow into the main gallery 50.

To the main gallery 50 connected are oil jets 71 for injecting oil to back surfaces of the four pistons 24, the bearing metals 29 of the five bearing portions 28 for rotatably supporting the crankshaft 26, bearing metals 72 disposed on crank pins to which the four connecting rods 25 are rotatably connected, an oil supply portion 73 for supplying oil to a hydraulic chain tensioner, an oil jet 74 for injecting oil to a timing chain, and a hydraulic pressure sensor 50*a* for detecting a hydraulic pressure of oil flowing through the main gallery 50. Oil is constantly supplied to the main gallery 50. Each of the oil jets 71 and 74 includes a relief valve and a nozzle. When a hydraulic pressure not less than a hydraulic pressure threshold value Pth is supplied to the oil jets 71 and 74, the relief valves are opened, and oil is injected from the nozzles.

Further, the control oil supply passage 54 connected to the pressure chamber 81*m* of the oil pump 81 via an oil control valve 84 is branched from the main gallery 50. An oil filter 54*a* is provided in the control oil supply passage 54. Oil in the main gallery 50 passes through the control oil supply passage 54. After a hydraulic pressure is adjusted by the oil control valve 84, oil is allowed to flow into the pressure chamber 81*m* of the oil pump 81. In other words, the oil control valve 84 controls a pressure of the pressure chamber 81*m*.

The oil control valve 84 (an example of the adjusting device) is a linear solenoid valve. The oil control valve 84 adjusts a flow rate of oil to be supplied to the pressure chamber 81*m* of the oil pump 81 according to a duty value (an example of the control value) of a control signal to be input from a controller 60 (to be described later). Control of the oil control valve 84 by the controller 60 will be described later in detail.

The second communication passage 52 communicates between the main gallery 50 and the third communication passage 53. Oil flowing through the main gallery 50 is allowed to flow into the third communication passage 53 via the second communication passage 52. Oil flowing through the third communication passage 53 is distributed to an intake side and an exhaust side of the cylinder head 1 via the first oil supply passage 55 and the second oil supply passage 56.

To the first oil supply passage 55, oil supply portions 91 for bearing metals for supporting cam journals of the intake-side camshaft 41, an oil supply portion 92 for a thrust bearing of the intake-side camshaft 41, the pivot mechanism 45*c* of the HLA 45*a* including a valve stopping mechanism, the HLA 45*b* without a valve stopping mechanism, the intake-side oil shower 48, and an oil supply portion 93 for a sliding portion of the intake-side VVT mechanism are connected.

To the second oil supply passage 56, oil supply portions 94 for bearing metals for supporting cam journals of the exhaust-side camshaft 42, an oil supply portion 95 of a thrust bearing of the exhaust-side camshaft 42, a pivot mechanism 46*c* of the HLA 46*a* including a valve stopping mechanism, the HLA 46*b* without a valve stopping mechanism, and the exhaust-side oil shower 49 are connected.

The third oil supply passage 57 is connected to the retard angle hydraulic chamber 81*e* and to the advance angle hydraulic chamber 18*f* of the exhaust-side VVT mechanism 18 via a first direction switching valve 96. Further, to the third oil supply passage, the frontmost oil supply portion 94 of the oil supply portions 94 for bearing metals of the exhaust-side camshaft 42 is connected. An oil filter 57*a* is connected to an upstream portion of the first direction switching valve 96 in the third oil supply passage 57. A flow rate of oil to be supplied to the retard angle hydraulic chamber 18*e* and to the advance angle hydraulic chamber 18*f* is adjusted by the first direction switching valve 96.

The fourth oil supply passage 58 is connected to the valve stopping mechanism 45*d* of the HLA 45*a* including a valve stopping mechanism, and to a valve stopping mechanism 46*d* of the HLA 46*a* including a valve stopping mechanism of the first cylinder via a second direction switching valve 97. An oil filter 58*a* is connected to an upstream portion of the second direction switching valve 97 in the fourth oil supply passage 58. Oil supply to the valve stopping mechanism 45*d* and to the valve stopping mechanism 46*d* of the first cylinder is controlled by the second direction switching valve 97.

The fifth oil supply passage 59 is connected to the valve stopping mechanism 45*d* of the HLA 45*a* including a valve stopping mechanism, and to the valve stopping mechanism 46*d* of the HLA 46*a* including a valve stopping mechanism of the fourth cylinder via a third direction switching valve 98. An oil filter 59*a* is connected to an upstream portion of the third direction switching valve 98 in the fifth oil supply passage 59. Oil supply to the valve stopping mechanism 45*d* and to the valve stopping mechanism 46*d* of the fourth cylinder is controlled by the third direction switching valve 98.

Oil supplied to each part of the engine 100 drops onto the oil pan 3 through an unillustrated drain oil passage, and is circulated by the oil pump 81 again.

The engine 100 is controlled by the controller 60 (an example of the hydraulic controller, an example of the determination portion). The controller 60 includes a central processing unit (CPU) 60*a*, and a memory 60*b* (an example of the memory). Detection results from various sensors 61 to 66 and the hydraulic pressure sensor 50*a* which detect an operating state of the engine 100 are input to the controller 60. For example, the crank angle sensor 61 detects a rotational angle of the crankshaft 26. The air flow sensor 62 detects an amount of air to be sucked by the engine 100. The oil temperature sensor 63 detects a temperature of oil flowing through the main gallery 50, and detects viscosity characteristics of the oil. The cam angle sensor 64 detects a rotational phase of each of the camshafts 41 and 42. The water temperature sensor 65 detects a temperature of cooling water for the engine 100. The controller 60 acquires an engine rotational speed based on a detection signal from the crank angle sensor 61. The temperature sensor 66 detects an ambient temperature of an engine room. The controller 60 acquires an engine load based on a detection signal from the air flow sensor 62. The controller 60 acquires an operating angle of each of the intake-side VVT mechanism and the exhaust-side VVT mechanism 18 based on a detection signal from the cam angle sensor 64.

The controller 60 determines an operating state of the engine 100 based on various detection results, and controls the oil control valve 84, the first direction switching valve 96, the second direction switching valve 97, and the third direction switching valve 98 depending on a determined operating state.

An example of engine control by the controller 60 is a reduced-cylinder operation. The controller 60 switches, depending on an operating state of the engine 100, between an all-cylinder operation mode, in which combustion is performed by all the cylinders, and a reduced-cylinder operation mode, in which combustion in a part of the cylinders is stopped and combustion is performed by the remaining cylinders.

Figure 6:
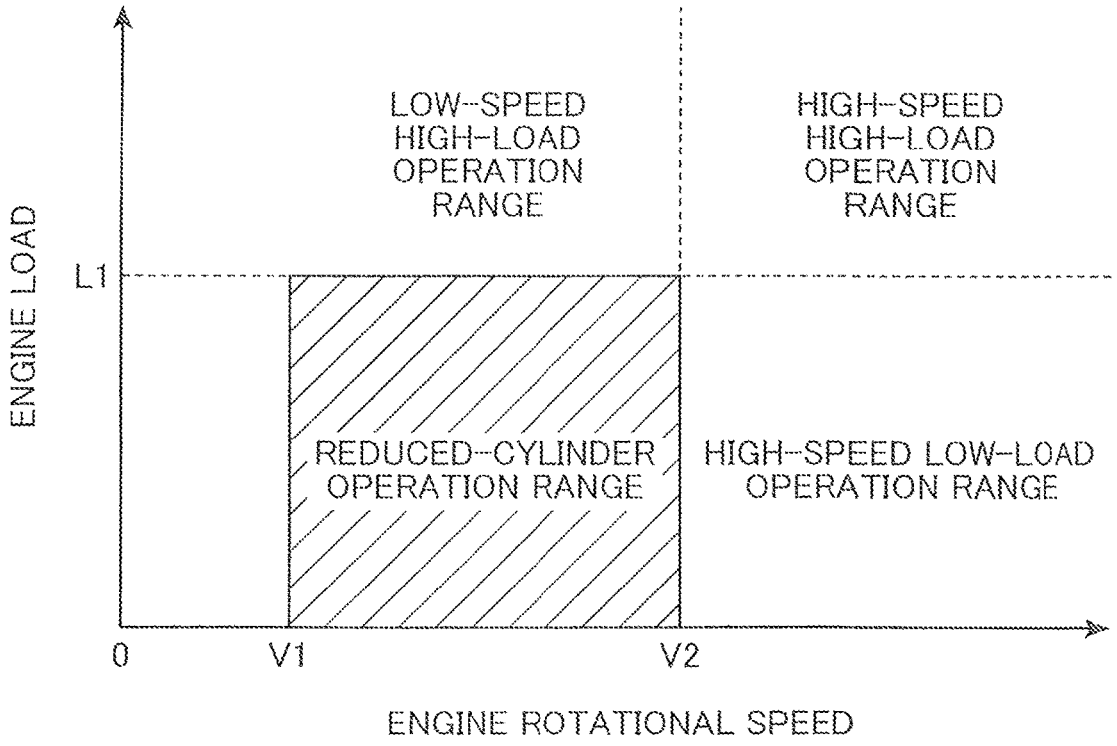
FIG. 6 is a diagram schematically illustrating a reduced-cylinder operation range of the engine.
Figure 7:
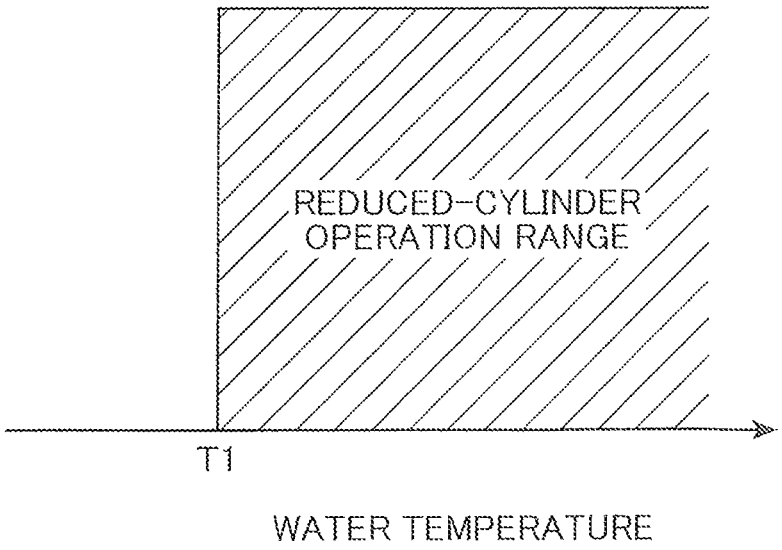
FIG. 7 is a diagram schematically illustrating the reduced-cylinder operation range of the engine.

FIG. 6 and FIG. 7 are diagrams schematically illustrating a reduced-cylinder operation range of the engine 100. FIG. 6 illustrates a reduced-cylinder operation range with respect to an engine load and an engine rotational speed. FIG. 7 illustrates a reduced-cylinder operation range with respect to a water temperature.

The controller 60 performs a reduced-cylinder operation when an operating state of the engine 100 is in a reduced-cylinder operation range indicated in FIG. 6, specifically, in a low-speed low-load range. Further, the controller 60 performs an all-cylinder operation when an operating state of the engine 100 is in a range other than the above, in other words, in a low-speed high-load range, a high-speed high-load range, and a high-speed low-load range.

For example, when an engine rotational speed is increased at an engine load of L1 or lower, an all-cylinder operation is performed when the engine rotational speed is lower than a predetermined rotational speed V1, and a reduced-cylinder operation is performed when the engine rotational speed becomes not lower than V1. Further, for example, when an engine rotational speed is decreased at an engine load of L1 or lower, an all-cylinder operation is performed when the engine rotational speed is higher than V2, and a reduced-cylinder operation is performed when the engine rotational speed becomes not higher than V2.

Further, an all-cylinder operation mode and a reduced-cylinder operation mode are also switched depending on a water temperature. As illustrated in FIG. 7, when a vehicle drives at an engine rotational speed of not lower than V1 but not higher than V2 and at an engine load of not higher than L1, the engine 100 is warmed up, and a water temperature is increased, an all-cylinder operation is performed when the water temperature is lower than T1, and a reduced-cylinder operation is performed when the water temperature is not lower than T1. In the embodiment, as will be described later in detail, the controller 60 sets the threshold value T1 to a temperature Tp0 or to a temperature Tp1.

Further, the controller 60 controls a discharge amount of the oil pump 81 depending on an operating state of the engine 100. Specifically, the controller 60 sets a target hydraulic pressure depending on an operating state of the engine 100. The controller 60 controls the oil control valve 84 to cause a detected hydraulic pressure detected by the hydraulic pressure sensor 50*a* to coincide with the target hydraulic pressure.

First of all, setting a target hydraulic pressure is described. In the oil supply control device 200 in the embodiment, oil is supplied to a plurality of hydraulic actuating devices by one oil pump 81. A hydraulic pressure required by each of the hydraulic actuating devices changes depending on an operating state of the engine 100. Therefore, in order to acquire a hydraulic pressure necessary for all the hydraulic actuating devices in all the operating states of the engine 100, the controller 60 is required to set a hydraulic pressure not less than a maximum hydraulic pressure among required hydraulic pressures of the respective hydraulic actuating devices, as a target hydraulic pressure for each operating state of the engine 100.

In the embodiment, examples of the hydraulic actuating device having a relatively large required hydraulic pressure include the exhaust-side VVT mechanism 18, the HLAs 45*a* and 46*a* (an example of the valve stopping device) including a valve stopping mechanism, and the oil jet 71 (an example of the hydraulic actuating device). Therefore, setting a target hydraulic pressure in such a manner as to satisfy required hydraulic pressures of these hydraulic actuating devices makes it possible to satisfy a required hydraulic pressure of a hydraulic actuating device having a relatively small required hydraulic pressure.

Further, a predetermined hydraulic pressure is required for a lubricating portion such as the bearing metal 29 other than the hydraulic actuating devices. A required hydraulic pressure of the lubricating portion also changes depending on an operating state of the engine 100. Among the lubricating portions, a required hydraulic pressure of the bearing metal 29 is relatively high. Therefore, as far as a required hydraulic pressure of the bearing metal 29 is satisfied, required hydraulic pressures of the other lubricating portions are also satisfied. In the embodiment, the controller 60 sets a hydraulic pressure slightly higher than a required hydraulic pressure of the bearing metal 29, as a base hydraulic pressure required for a steady operation of the engine 100 when a hydraulic actuating device is not activated.

The controller 60 compares a base hydraulic pressure, a required hydraulic pressure when each of the hydraulic actuating devices is activated, and a required hydraulic pressure necessary for lubricating a lubricating portion, and sets a maximum hydraulic pressure among the hydraulic pressures as a target hydraulic pressure.

A base hydraulic pressure and a required hydraulic pressure change depending on an operating state of the engine, for example, an engine load, an engine rotational speed, and an oil temperature. In view of the above, the memory 60*b* of the controller 60 stores a base hydraulic pressure map corresponding to an engine load, an engine rotational speed, and an oil temperature, and a required hydraulic pressure map corresponding to an engine load, an engine rotational speed, and an oil temperature. In the embodiment, maps illustrated in FIG. 8 to FIG. 11 are stored in the memory 60*b* of the controller 60.

FIG. 8 is a diagram illustrating a base hydraulic pressure map. FIG. 9 is a diagram illustrating a required hydraulic pressure map of the valve stopping mechanisms 45*d* and 46*d*. FIG. 10 is a diagram illustrating a required hydraulic pressure map of an oil jet. FIG. 11 is a diagram illustrating a required hydraulic pressure map of the exhaust-side VVT mechanism 18. In each of the maps, left three columns i.e. "operating state", "rotational speed", and "load" describe a condition for a required hydraulic pressure, specifically, a condition in which each of the hydraulic actuating devices is activated. When a base hydraulic pressure or a required hydraulic pressure changes depending on an oil temperature, a plurality of hydraulic pressures are described in the "oil temperature" column, and a base hydraulic pressure or a required hydraulic pressure is set for each oil temperature.

Further, numerals such as "1000" described in cells on a right side of "oil temperature" in the first row indicate engine rotational speeds. When a base hydraulic pressure or a required hydraulic pressure changes depending on an engine rotational speed, a base hydraulic pressure or a required hydraulic pressure depending on an engine rotational speed is set. The unit of an engine rotational speed is rpm. The unit of a base hydraulic pressure or a required hydraulic pressure set in the maps is kPa.

Note that FIG. 8 to FIG. 11 are excerpts of a part of the maps. Each hydraulic pressure may be set by subclassifying an operating state of the engine 100, an engine rotational speed, an engine load, or an oil temperature. Further, in the maps, hydraulic pressures are discretely set depending on an engine rotational speed or the like. Therefore, a hydraulic pressure at an engine rotational speed or the like, which is not set in the maps, is acquired by linear interpolation of hydraulic pressures set in the maps.

A base hydraulic pressure is a hydraulic pressure necessary for a steady operation of the engine 100 when a hydraulic actuating device is not activated. Therefore, as illustrated in FIG. 8, a specific condition (an operating state, an engine rotational speed, or an engine load) for a base hydraulic pressure is not defined. A base hydraulic pressure is set depending on an oil temperature and an engine rotational speed. It is necessary to lubricate a lubricating portion such as the bearing metal 29, as an engine rotational speed increases. In view of the above, a base hydraulic pressure is set to increase, as an engine rotational speed increases. Note that when an engine rotational speed is in an intermediate speed range, a base hydraulic pressure is set to a substantially fixed value. Further, a base hydraulic pressure is set to decrease, as an oil temperature (Ta1>Ta2>Ta3) is lowered in a low rotational speed range.

As illustrated in FIG. 9, two required hydraulic pressures i.e. a required hydraulic pressure when valve deactivation is performed, and a required hydraulic pressure when valve deactivation is retained are set as required hydraulic pressures of the valve stopping mechanisms 45*d* and 46*d*. The valve stopping mechanisms 45*d* and 46*d* are activated when it is determined that valve deactivation is necessary depending on an operating state of the engine 100. Therefore, as illustrated in FIG. 9, in the map, a specific engine rotational speed and a specific engine load are not defined as an activation condition.

As described above, the valve stopping mechanisms 45*d* and 46*d* are brought to a state that valve deactivation is enabled when the lock pins 45*g* are pressed against a biasing force of the lock spring 45*h* by a hydraulic pressure. After valve deactivation is performed, the lock pins 45*g* are brought to an accommodated state within the outer cylinder 45*e*. Therefore, it is not necessary to apply a hydraulic pressure capable of pressing the lock pins 45*g* against a biasing force of the lock spring 45*h*. Thus, a required hydraulic pressure P2 for retaining valve deactivation is set smaller than a required hydraulic pressure P1 for performing valve deactivation.

An operating condition for the oil jet 71 is defined depending on a presence or absence of cylinder deactivation (valve stopping), an engine rotational speed, and an engine load. The oil jet 71 injects oil through a nozzle when a relief valve is opened by a hydraulic pressure. Therefore, as illustrated in FIG. 10, a required hydraulic pressure of the oil jet 71 is set to a fixed hydraulic pressure P3. A threshold value of a hydraulic pressure at which a relief valve of the oil jet 71 is opened is the hydraulic pressure threshold value Pth. Therefore, Pth<P3.

As illustrated in FIG. 11, a required hydraulic pressure of the exhaust-side VVT mechanism 18 is set depending on an oil temperature and an engine rotational speed. The required hydraulic pressure is set in such a manner that the required hydraulic pressure increases as an engine rotational speed increases, and decreases as an oil temperature (Tc1<Tc2<Tc3) lowers.

Next, control of the oil control valve 84 by the controller 60 is described in detail. As described above, the oil control valve 84 is a linear solenoid valve. The oil control valve 84 controls a discharge amount of the oil pump 81 depending on an operating state of the engine 100. When the oil control valve 84 is opened, oil is supplied to the pressure chamber 81*m* of the oil pump 81. The controller 60 controls a discharge amount (flow rate) of the oil pump 81 by driving the oil control valve 84. Note that a configuration of the oil control valve 84 itself is well-known. Therefore, further detailed description on the oil control valve 84 is omitted.

Specifically, the oil control valve 84 is driven in response to a control signal indicative of a duty value, which is transmitted from the controller 60 based on an operating state of the engine 100, and a hydraulic pressure to be supplied to the pressure chamber 81*m* of the oil pump 81 is controlled. An eccentric amount of the cam ring 81*d* is controlled by a hydraulic pressure of the pressure chamber 81*m*, and a discharge amount (flow rate) of the oil pump 81 is controlled by adjusting an amount of change in internal volume of the pump chamber 81*i*. In other words, a capacity of the oil pump 81 is controlled by a duty value to be input from the controller 60 to the oil control valve 84.

Figure 12:
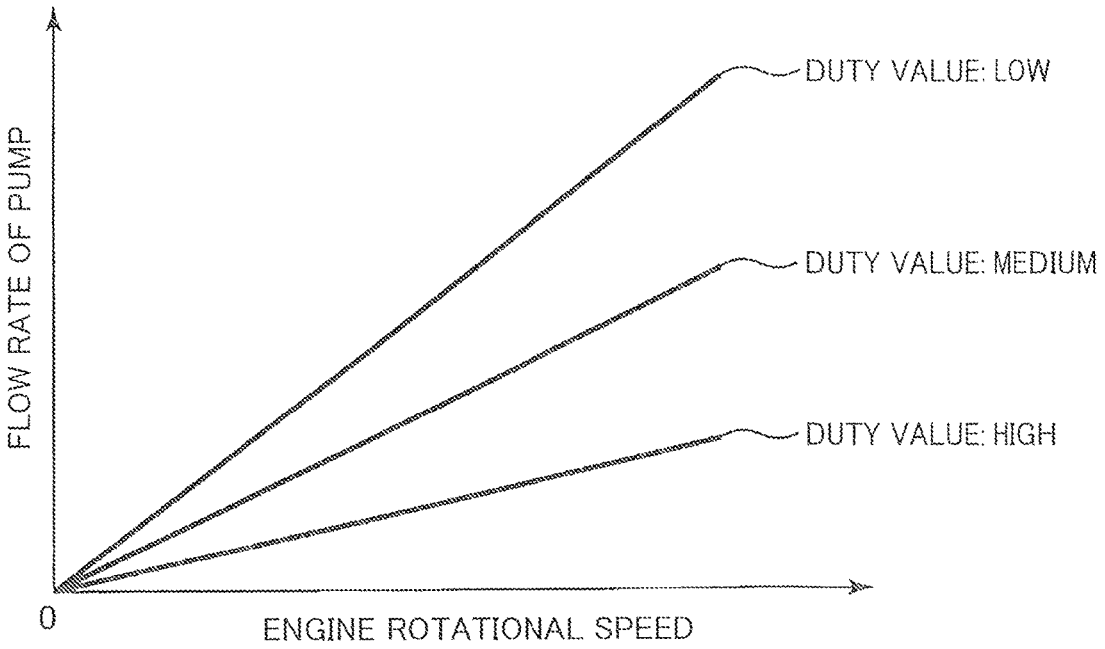
FIG. 12 is a diagram schematically illustrating characteristics of an oil pump to be controlled by an oil control valve.

FIG. 12 is a diagram schematically illustrating characteristics of the oil pump 81 to be controlled by the oil control valve 84. The oil pump 81 is driven by the crankshaft 26 of the engine 100. Therefore, as illustrated in FIG. 12, a flow rate (discharge amount) of the oil pump 81 is proportional to an engine rotational speed. In this example, a duty value indicates a ratio of energization time to the oil control valve 84 with respect to time of one cycle. Therefore, as a duty value to be input to the oil control valve 84 increases, a hydraulic pressure to the pressure chamber 81*m* of the oil pump 81 increases. Thus, as illustrated in FIG. 12, as a duty value increases, a slope of the flow rate of the oil pump 81 with respect to an engine rotational speed decreases.

FIG. 13 is a diagram schematically illustrating master data 1300 stored in advance in the memory 60*a* of the controller 60. The master data 1300 (an example of the first master data) is a map of duty values set for each oil temperature and for each engine rotational speed.

FIG. 14 is a diagram schematically illustrating a correction coefficient map 1400 stored in advance in the memory 60*a* of the controller 60. The correction coefficient map 1400 is a map of correction coefficients set for each oil temperature and for each engine rotational speed. Note that in FIG. 13 and FIG. 14, illustration of specific duty values and specific correction coefficients is omitted.

The master data 1300 indicates duty values when the controller 60 controls the oil control valve 84 by setting a predetermined reference hydraulic pressure P0 as a target hydraulic pressure in an initial state of the engine. Duty values of the master data 1300 are acquired experimentally, for example. In the experiment, it is preferable to use the oil control valve 84 which indicates a median when characteristics of the oil control valve 84 fluctuate, and brand new oil having viscosity characteristics by which an operation of a vehicle is guaranteed. A relatively low viscosity may be used as viscosity characteristics of oil.

As described above, a duty value indicates a ratio of energization time to the oil control valve 84 with respect to time of one cycle. Therefore, the unit of a duty value is %. As the reference hydraulic pressure P0, for example, a base hydraulic pressure at an intermediate engine rotational speed may be used.

The correction coefficient map 1400 is used in order to correct the master data 1300 and reflect individual differences of engines 100 actually mounted in vehicles to the master data 1300. It is assumed that a numerical value of correction coefficient changes for each oil temperature and for each engine rotational speed. In view of the above, the correction coefficient map 1400 illustrated in FIG. 14 is generated in advance, and is stored in the memory 60*b*. A procedure for correcting the master data 1300 with use of the correction coefficient map 1400 will be described later in detail.

As described above, the oil supply control device 200 in the embodiment includes, as hydraulic actuating devices having a relatively large required hydraulic pressure, the HLAs 45*a* and 46*a* including a valve stopping mechanism, the exhaust-side VVT mechanism 18, and the oil jet 71. The controller 60 allows activation of these hydraulic actuating devices only when these hydraulic actuating devices are securely activatable. In view of the above, an activation allowance range of each of the hydraulic actuating devices is stored in advance in the memory 60*b*.

Whether or not each of the hydraulic actuating devices is appropriately activated greatly depends on a viscosity of oil. A variety of oil types are prepared as oil types which guarantee an operation with respect to a vehicle in which the engine 100 is mounted. Further, a viscosity changes relatively widely even with use of oil of a same type. In view of the above, an activation allowance range of each of the hydraulic actuating devices is set to a relatively narrow range.

In particular, in the embodiment, as described referring to FIG. 6 and FIG. 7, in a low engine rotational speed low engine load range, a reduced-cylinder operation is performed by releasing the lock pins 45*g* of the HLAs 45*a* and 46*a* including a valve stopping mechanism to perform cylinder deactivation control so as to improve fuel economy.

When a command signal indicative of the target hydraulic pressure P1 is output from the controller 60 to the oil control valve 84 in activating a valve stopping mechanism, a hydraulic pressure of the oil supply passage 5 reaches the target hydraulic pressure P1, and the lock pins 45*g* are released. In this case, it is necessary to release the lock pins 45*g* within a predetermined period of time after a command signal is output from the controller 60. However, when a viscosity of oil is high, it takes time to fill the oil supply passage 5 with oil and to attain the target hydraulic pressure P1.

In view of the above, in the oil supply control device 200 of the embodiment, a viscosity of oil in use is estimated in order to increase the activation allowance range as much as possible. This allows for the oil supply control device 200 of the embodiment to improve fuel economy or increase an engine output.

Figure 15:
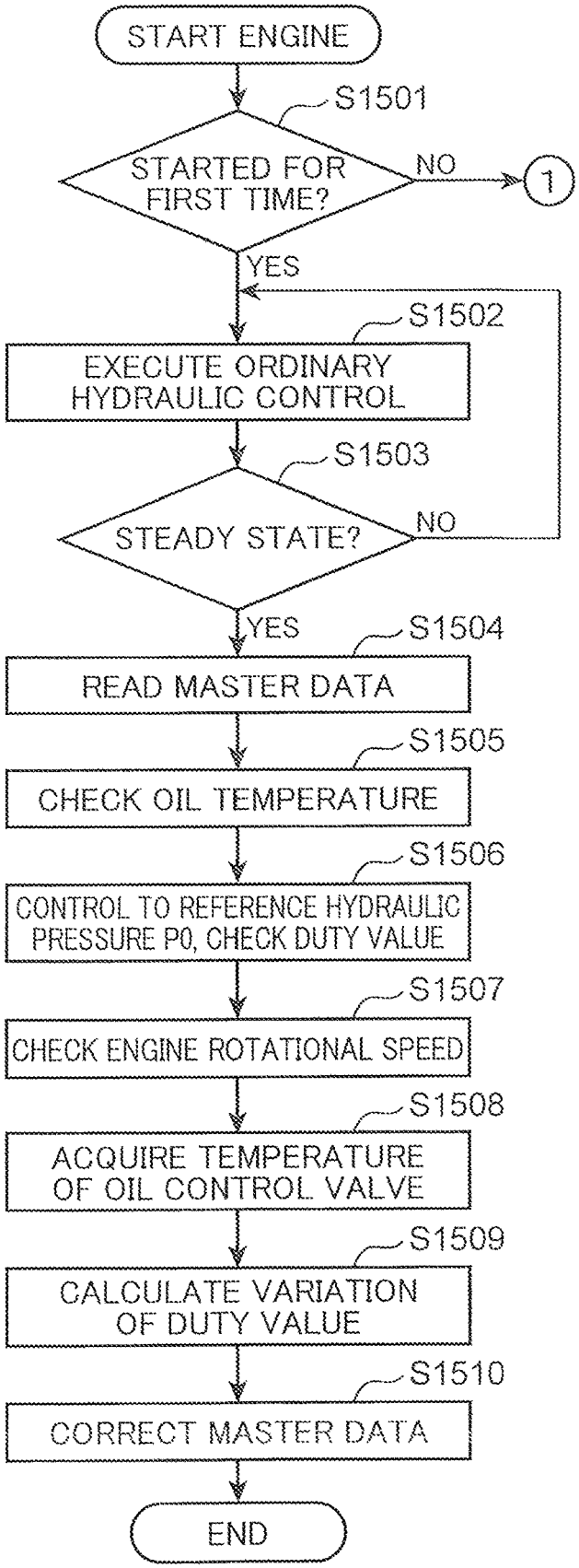
FIG. 15 is a flowchart schematically illustrating an operation of the oil supply control device to be performed when the engine is started for a first time.
Figure 16:
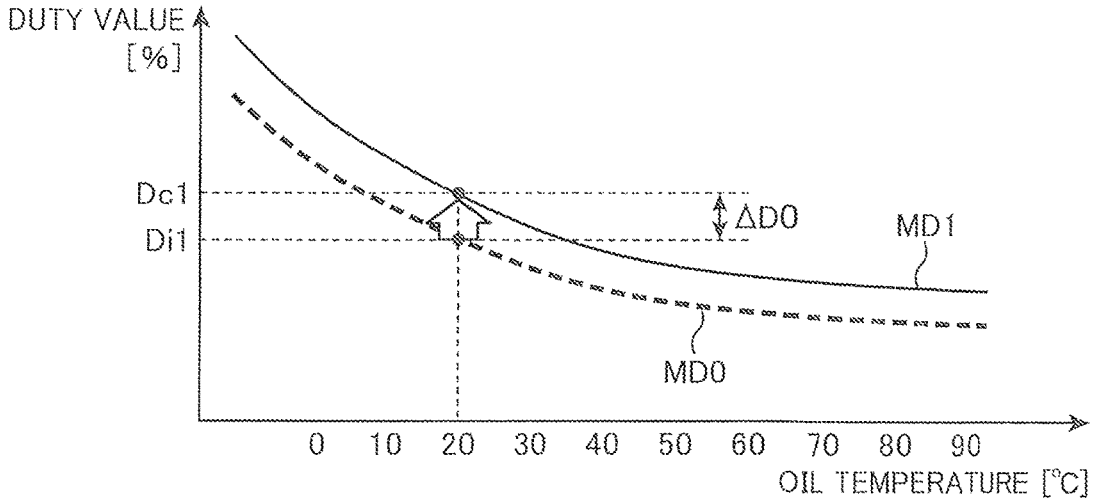
FIG. 16 is a diagram schematically illustrating correction of the master data.

FIG. 15 is a flowchart schematically illustrating an operation of the oil supply control device 200 to be performed when the engine 100 is started for a first time. FIG. 16 is a diagram schematically illustrating an example of master data before and after correction.

When the engine 100 is started, an operation illustrated in FIG. 15 is started. First of all, in Step S1501, the controller 60 judges whether or not the engine 100 is started for a first time. When the engine 100 is not started for a first time, in other words, when the engine 100 is started at a second time or thereafter (NO in Step S1501), the processing proceeds to Step S1701 of FIG. 17 to be described later.

On the other hand, when the engine 100 is started for a first time (YES in Step S1501), the processing proceeds to Step S1502. The operation of Step S1502 and thereafter in FIG. 15 is performed, for example, in a final inspection step in a manufacturing process of a vehicle in which the engine 100 is mounted. Note that the controller 60 can easily judge whether the engine 100 is started for a first time, or at a second time and thereafter by a well-known flag setting method or the like.

In Step S1502, the controller 60 executes ordinary hydraulic control. For example, when a target hydraulic pressure is set to the reference hydraulic pressure P0, the controller 60 extracts, from the master data 1300 (FIG. 13) stored in the memory 60*b*, a duty value which corresponds to an oil temperature detected by the oil temperature sensor 63 and an engine rotational speed acquired based on a detection signal from the crank angle sensor 61. The controller 60 outputs the extracted duty value to the oil control valve 84. Further, the controller 60 adjusts a duty value to be output to the oil control valve 84 based on a detected hydraulic pressure to be detected by the hydraulic pressure sensor 50*a*, and makes the detected hydraulic pressure coincide with the target hydraulic pressure P0.

Next, in Step S1503, the controller 60 judges whether or not the engine 100 is in a steady state. When the engine rotational speed and the engine load are constant (e.g. when the engine 100 is in an idling state), the controller 60 judges that the engine 100 is in a steady state. When the engine 100 is not in a steady state (NO in Step S1503), the processing returns to Step S1502, and the controller 60 waits until the engine 100 is brought to a steady state while executing ordinary hydraulic control.

When it is judged that the engine 100 is in a steady state (YES in Step S1503), the controller 60 reads the master data 1300 (FIG. 13) stored in the memory 60*b* (Step S1504). Subsequently, the controller 60 checks an oil temperature detected by the oil temperature sensor 63 (Step S1505). Subsequently, the controller 60 checks a duty value at which the detected hydraulic pressure by the hydraulic pressure sensor 50*a* is coincident with a target hydraulic pressure (i.e. the reference hydraulic pressure P0) (Step S1506). Subsequently, the controller 60 checks an engine rotational speed acquired based on a detection signal from the crank angle sensor 61 (Step S1507). Subsequently, the controller 60 acquires a temperature of the oil control valve 84 (Step S1508).

In Step S1508, the controller 60 may acquire an ambient temperature of an engine room detected by the temperature sensor 66, as a temperature of the oil control valve 84. Further, the oil supply control device 200 in the embodiment may include a temperature sensor for detecting a temperature of the oil control valve 84.

A resistance value of a solenoid of the oil control valve 84 also changes depending on a temperature. Therefore, even when a same duty value is output to the oil control valve 84, a value of current flowing through the solenoid of the oil control valve 84 changes depending on a temperature. In view of the above, in the embodiment, correction coefficients depending on a temperature are stored in advance in the memory 60*b*. The controller 60 corrects a duty value with use of a temperature of the oil control valve 84 acquired in Step S1508, and a correction coefficient stored in the memory 60*b*. This point is the same as a case where a temperature of the oil control valve 84 is acquired in an operation to be described in the following.

Next, in Step S1509, the controller 60 calculates a variation of duty value. Specifically, the controller 60 extracts, from the master data 1300 read in Step S1504, a duty value corresponding to an oil temperature checked in Step S1505 and an engine rotational speed checked in Step S1507. Then, the controller 60 calculates a difference between the duty value extracted from the master data 1300, and the duty value checked in Step S1506, as a variation of duty value.

Next, in Step S1510, the controller 60 corrects the master data 1300 stored in the memory 60*b* with use of a variation of duty value calculated in Step S1509, and the correction coefficient map 1400 illustrated in FIG. 14. In the following, calculating a variation of duty value in Step S1509, and correcting the master data 1300 in Step S1510 will be described in detail referring to FIG. 16.

FIG. 16 is a diagram schematically illustrating correcting the master data 1300 in Step S1510. In FIG. 16, the vertical axis denotes a duty value, and a horizontal axis denotes an oil temperature. Generally, when an oil temperature increases, a viscosity of oil lowers. When a viscosity of oil lowers, an amount of oil leakage from a clearance of each part of the engine increases. In view of the above, it is necessary to increase an oil discharge amount from the oil pump 81 in order to implement a same target hydraulic pressure. Therefore, as illustrated in FIG. 16, a duty value is lowered in order to increase a discharge amount of oil when an oil temperature increases.

The broken line MD0 in FIG. 16 indicates a part of the master data 1300 stored in advance in the memory 60*b*. Concretely, the broken line MD0 indicates a duty value for each oil temperature at an engine rotational speed checked in Step S1507, when the reference hydraulic pressure P0 is set as a target hydraulic pressure. Specifically, the broken line MD0 corresponds to a duty value in an engine rotational speed column checked in Step S1507 among the master data 1300 in FIG. 13. In other words, data as indicated by the broken line MD0 in FIG. 16 is stored for each engine rotational speed, as the master data 1300 in the memory 60*b*. Further, the solid line MD1 illustrated in FIG. 16 indicates corrected master data after correction in Step S1510.

In FIG. 16, the duty value Dc1 is a duty value checked in Step S1506. Further, the duty value Di1 is a duty value extracted from the master data 1300, in other words, a duty value corresponding to an oil temperature checked in Step S1505 and an engine rotational speed checked in Step S1507. Note that in the embodiment, an oil temperature checked in Step S1505 is assumed to be 20 [° C.].

In Step S1509, the controller 60 calculates a variation ADO of duty value by the following formula (1) for example.

$$\Delta D0 = Dc1 - Di1 \quad (1)$$

Further, in Step S1510, the controller 60 corrects the master data 1300 stored in the memory 60*b* by the following formula (2) for example.

$$Dc = Di + \Delta Dc \times Cf/Cf0 \quad (2)$$

In formula (2), the duty value Di is a duty value in an arbitrary cell of the master data 1300 illustrated in FIG. 13. The duty value Dc is a duty value acquired by correcting the duty value Di. The correction coefficient Cf is a correction coefficient in a cell associated with the duty value Di in the correction coefficient map 1400 illustrated in FIG. 14. For example, when the duty value Di in FIG. 13 is a duty value such that an engine rotational speed is 1400 [rpm] and an oil temperature is 25 [° C.], the correction coefficient Cf in FIG. 14 is a correction coefficient when an engine rotational speed is 1400 [rpm] and an oil temperature is 25 [° C.]. The correction coefficient Cf0 is a correction coefficient corresponding to an engine rotational speed and an oil temperature checked in Step S1507.

When a duty value is shifted in parallel by the variation ADO calculated in Step S1509 in correcting the master data 1300 stored in the memory 60*b*, the variation ADO may be added to a duty value in each cell of the master data 1300 illustrated in FIG. 13. However, when the variation ADO is equally added to each of the duty values, as is clear from FIG. 16, a correction width is excessively small, because an absolute value of duty value is large in a low temperature range. Conversely, a correction width may be excessively large because an absolute value of duty value is small in a high temperature range.

Further, the variation ADO of duty value acquired in Step S1509 is a variation in engine rotational speed checked in Step S1507. When the variation ADO of duty value is added to a duty value of another engine rotational speed as it is, an appropriate correction width may not be acquired.

In view of the above, in the embodiment, the correction coefficient Cf is acquired for each oil temperature and for each engine rotational speed in order to acquire an appropriate correction width for each oil temperature and for each engine rotational speed. The correction coefficients Cf are stored in advance in the memory 60*b* as the correction coefficient map 1400.

By performing Step S1510 in FIG. 15, it is possible to correct the entirety of the master data 1300 including the corrected master data MD1 (FIG. 16) stored in the memory 60*b* to data, in which individual differences of engines 100 are reflected.

Figure 18:
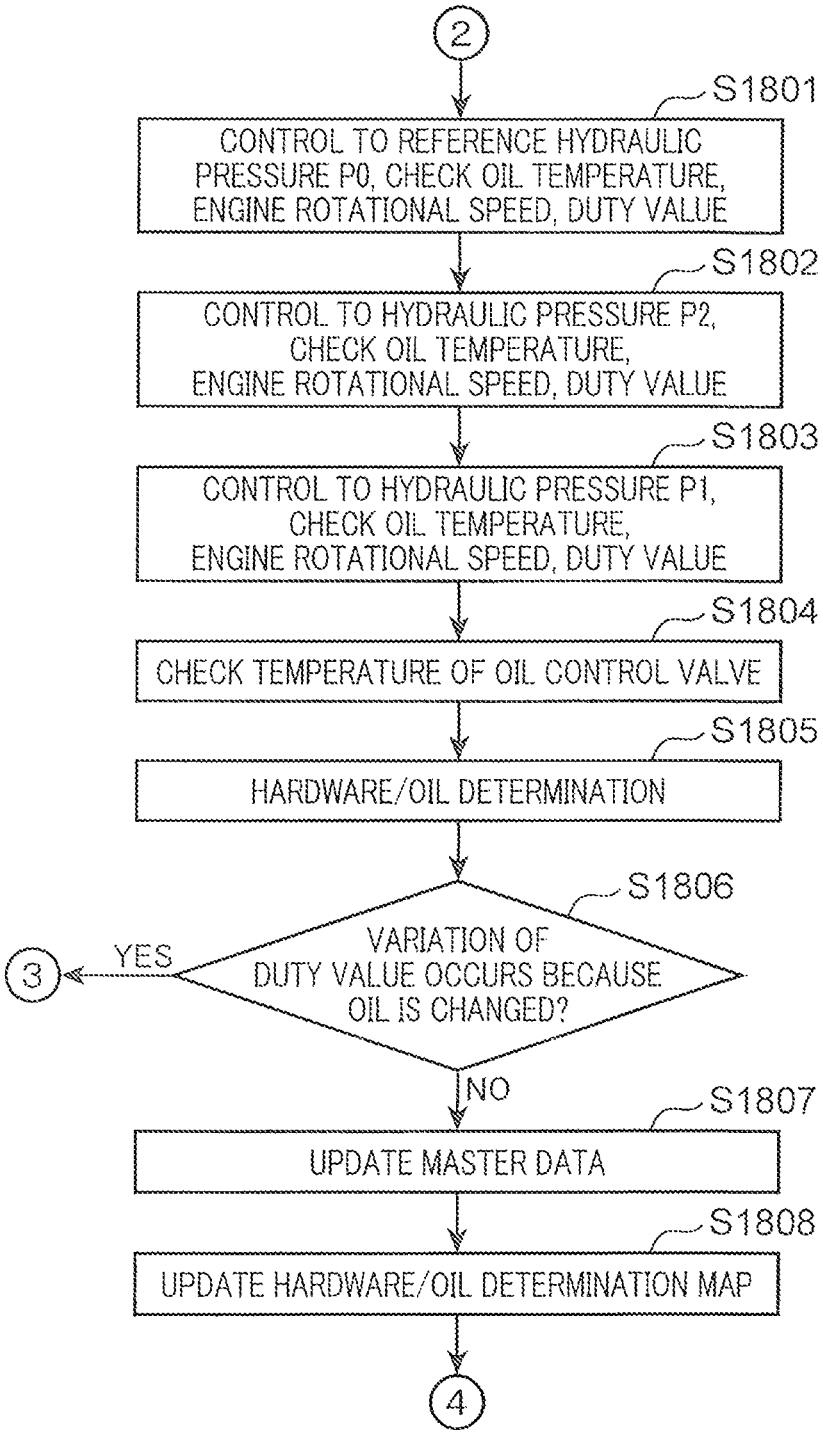
FIG. 18 is a flowchart schematically illustrating the operation of the oil supply control device to be performed when the engine is started at the second time and thereafter.

FIG. 17 and FIG. 18 are flowcharts schematically illustrating an operation of the oil supply control device 200 to be performed when the engine 100 is started at a second time and thereafter.

As described above, when the engine 100 is started, an operation illustrated in FIG. 15 is started. In Step S1501, when the engine 100 is not started for a first time, in other words, when the engine 100 is started at a second time and thereafter (NO in Step S1501), the processing proceeds to Step S1701 in FIG. 17.

Steps S1701, S1702, and S1703 are the same as Steps S1502, S1503, and S1504 in FIG. 15. Note that master data read from the memory 60*b* by the controller 60 in Step S1702 is master data corrected in Step S1510 in FIG. 15, or master data updated in Step S1711 in FIG. 17, or master data updated in Step S1807 in FIG. 18.

Next, in Step S1704, the controller 60 reads an activation allowance determination map stored in the memory 60*b*.

Figure 19:
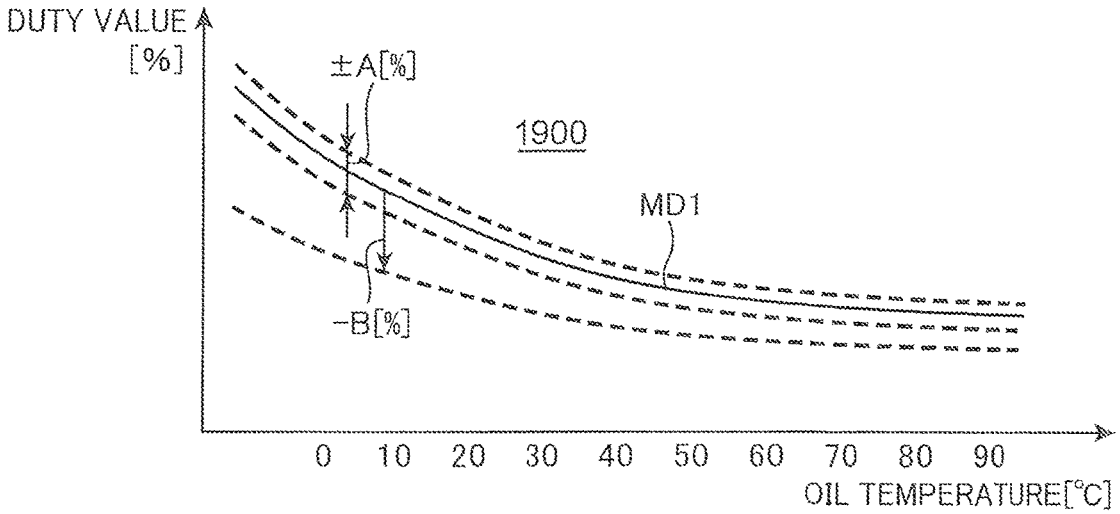
FIG. 19 is a diagram schematically illustrating an activation allowance determination map stored in advance in the memory.

FIG. 19 is a diagram schematically illustrating an activation allowance determination map 1900 stored in advance in the memory 60*b*. The activation allowance determination map 1900 indicates an allowable range of a duty value to be actually output from the controller 60 with respect to master data in order to make a detected hydraulic pressure to be detected by the hydraulic pressure sensor 50*a* coincide with a target hydraulic pressure.

The activation allowance determination map 1900 in FIG. 19 indicates an allowable range of a duty value with respect to the master data MD1 at a certain engine rotational speed. Note that the memory 60*b* stores an allowable range with respect to master data as illustrated in FIG. 19 as the activation allowance determination map 1900 for each engine rotational speed.

As illustrated in FIG. 19, in the activation allowance determination map 1900 in the embodiment, two types of allowable ranges i.e. an allowable range "within ±A [%]", which is set above and below the master data MD1, and an allowable range "within −B [%]", which is set below the master data MD1 are set. Note that |A|<|B| is set as illustrated in FIG. 19.

A magnitude |A| of the allowable range "within ±A [%]" is determined taking into consideration measurement fluctuation or aging change such as wear. Consequently, the allowable range "within ±A [%]" is set above and below the master data MD1. Note that as a clearance increases by wear among aging changes, oil leakage may increase. Thus, it is necessary to increase an oil supply amount in order to acquire a same hydraulic pressure. Therefore, generally, a duty value shifts upwardly regarding aging change.

As illustrated in FIG. 19, the allowable range "within-B [%]" is set only below the master data MD1. A fact that a duty value for acquiring a same hydraulic pressure is small means that it is necessary to increase an oil supply amount. In other words, it means that a viscosity of oil is low.

Further, a fact that a duty value for acquiring a same hydraulic pressure is smaller than a value exceeding the allowable range "within −A [%]" may mean that oil of a viscosity lower than the viscosity of oil used when the master data of FIG. 13 is experimentally acquired (in other words, oil used when the operation of FIG. 15 is performed in a final inspection step in a factory). Consequently, in the embodiment, in order to allow use of such low viscous oil, the allowable range "within −B [%]" wherein |A|<|B| is set. Note that a range of a variation of duty value of not more than −B [%] is not included in the allowable range, because it is assumed that a variation of duty value occurs because of a reason other than the reason that oil of low viscosity is used.

Referring back to FIG. 17, Steps S1705 to S1709 following Step S1704 are the same as Steps S1505 to S1509 in FIG. 15. Note that the controller 60 temporarily stores an oil temperature, a duty value, an engine rotational speed, a temperature of the oil control valve 84, and a variation of duty value acquired in Steps S1705 to S1709 in the memory 60*b*.

In Step S1710 following Step S1709, the controller 60 judges whether or not a variation of duty value calculated in Step S1709 lies within the allowable range "±A [%]". When the variation of duty value lies within the allowable range "±A [%]" (YES in Step S1710), the processing proceeds to Step S1711. On the other hand, when the variation of duty value does not lie within the allowable range "±A [%]" (NO in Step S1710), the processing proceeds to Step S1712.

In Step S1711, the controller 60 updates the master data stored in the memory 60*b* with use of a calculated variation of duty value. In Step S1711, as in Step S1510 in FIG. 15, the controller 60 overwrites the master data 1300 stored in the memory 60*b*. Specifically, the controller 60 updates the master data stored in the memory 60*b* with use of the above formula (2).

Updating the master data 1300 makes it possible to reflect a change in engine characteristics by aging change such as wear to the master data 1300. When master data is not updated, variations of duty value are integrated. As a result, when integration of variations of duty value progresses simply because of aging change, regardless that oil is not changed to oil of another viscosity, the integration result may exceed the allowable range. However, in the embodiment, by updating the master data 1300, it is possible to avoid integration of variations of duty value.

In Step S1712, the controller 60 judges whether or not a variation of duty value does not lie within the allowable range "±A [%]" in Step S1806 (FIG. 18) of a previous driving cycle because oil is changed. When it is determined that a variation of duty value does not lie within the allowable range "±A [%]" because oil is changed (YES in Step S1712), the processing proceeds to Step S1713.

The driving cycle means a period of time from start of the engine after an ignition switch is turned on until the engine is stopped after the ignition switch is turned off. Specifically, "a previous driving cycle" means an operation of FIG. 17 and FIG. 18 which is started by start of the engine at a previous time.

In Step S1712, when it is not determined that a variation of duty value does not lie within the allowable range "±A[%]" because oil is exchanged (NO in Step S1712), the processing proceeds to Step S1801 in FIG. 18.

In Step S1801, the controller 60 sets a target hydraulic pressure to the reference hydraulic pressure P0, checks an oil temperature, an engine rotational speed, and a duty value, and temporarily stores an oil temperature and a duty value D040 (FIG. 20 to be described later) in the memory 60*b*. Next, in Step S1802, the controller 60 sets a target hydraulic pressure to the hydraulic pressure P2, checks an oil temperature, an engine rotational speed, and a duty value, and temporarily stores an oil temperature and a duty value D240 (FIG. 20 to be described later) in the memory 60*b*.

Next, in Step S1803, the controller 60 sets a target hydraulic pressure to the hydraulic pressure P1, checks an oil temperature, an engine rotational speed, and a duty value, and temporarily stores an oil temperature and a duty value D140 (FIG. 20 to be described later) in the memory 60*b*. Next, in Step S1804, the controller 60 checks a temperature of the oil control valve 84. Note that as described above, the hydraulic pressure P1 is a required hydraulic pressure for performing valve deactivation, and the hydraulic pressure P2 is a required hydraulic pressure for retaining valve deactivation.

Next in Step S1805, the controller 60 determines whether a variation of duty value calculated in Step S1709 exceeds the allowable range because a hardware component is changed or because oil is changed. Changing a hardware component means changing an engine component such as the oil pump 81, the oil control valve 84, or an oil filter by a user, for example. Changing oil means changing oil to oil of another viscosity characteristics by a user at the time of oil exchange, for example.

In Step S1805, the controller 60 stores a determination result in the memory 60*b*. The controller 60 uses a determination result of Step S1805 stored in the memory 60*b* in Step S1712 (FIG. 17) of a next driving cycle.

Figure 20:
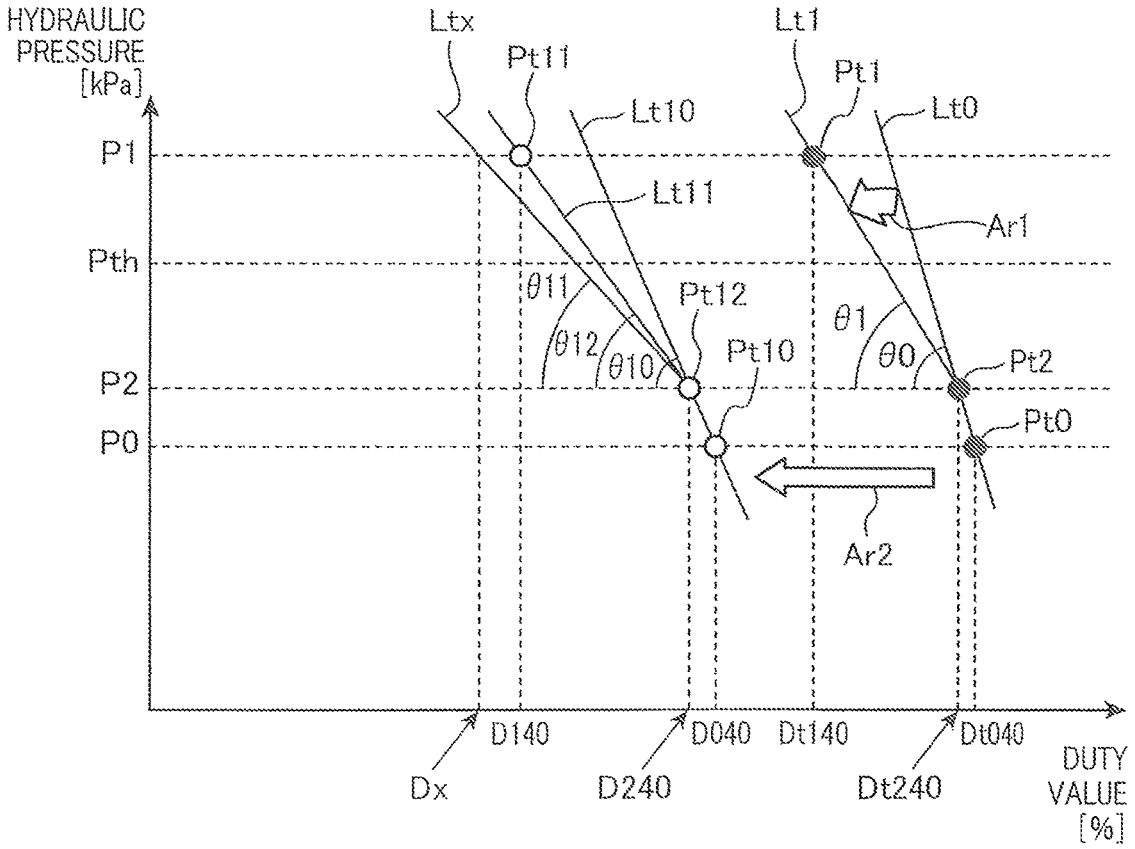
FIG. 20 is a diagram schematically illustrating duty values and the like acquired in Steps S1801 to S1803 in FIG. 18.

FIG. 20 is a diagram schematically illustrating duty values acquired in Steps S1801 to S1803 of FIG. 18. FIG. 21 is a diagram schematically illustrating an example of a hardware/oil determination map (hereinafter, simply referred to as a determination map) 2100 stored in the memory 60*b*. A determination method to be performed in Step S1805 of FIG. 18 is described using FIG. 20 and FIG. 21.

In FIG. 20, the horizontal axis (X-axis) denotes a duty value, and the vertical axis (Y-axis) denotes a hydraulic pressure. FIG. 20 illustrates the hydraulic pressures P1, P2, Pth, and P0. As described referring to FIG. 9, the hydraulic pressure P1 (an example of the second target hydraulic pressure) is a required hydraulic pressure for performing cylinder deactivation. The hydraulic pressure P2 (an example of the first target hydraulic pressure) is a required hydraulic pressure for retaining cylinder deactivation. Further, as described referring to FIG. 13, the hydraulic pressure P0 (an example of the third target hydraulic pressure) is a reference hydraulic pressure. Furthermore, as described referring to FIG. 10, the hydraulic pressure Pth is a hydraulic pressure threshold value at which a relief valve of the oil jet 71 is opened.

The points Pt0, Pt1, and Pt2 illustrated in FIG. 20 indicate duty values included in the determination map 2100 stored in the memory 60*b*. In the embodiment, it is assumed that an oil temperature checked in Steps S1801 to S1803 is 40° C. Therefore, a duty value (an example of the third initial coordinate value) at the point Pt0 of the hydraulic pressure P0 in FIG. 20 is a duty value Dt040 (an example of the third initial control value) corresponding to the hydraulic pressure P0 and the oil temperature 40° C. in the determination map 2100.

Further, a duty value at the point Pt2 (an example of the first initial coordinate value) of the hydraulic pressure P2 in FIG. 20 is a duty value Dt240 (an example of the first initial control value) corresponding to the hydraulic pressure P0 and the oil temperature 40° C. in the determination map 2100. Furthermore, a duty value at the point Pt1 (an example of the second initial coordinate value) of the hydraulic pressure P1 in FIG. 20 is a duty value Dt140 (an example of the second initial control value) corresponding to the hydraulic pressure P0 and the oil temperature 40° C. in the determination map 2100.

The determination map 2100 is generated in advance and stored in the memory 60*b* as is the case with the master data 1300. Further, the determination map 2100 is updated when an operation illustrated in FIG. 15 is performed, specifically, when the engine 100 is started for a first time. Therefore, the duty value Dt040 at the point Pt0 of the reference hydraulic pressure P0 in FIG. 20 and FIG. 21 is a same value as a duty value corresponding to a same oil temperature and a same engine rotational speed in the master data corrected in Step S1510.

Note that the determination map 2100 is used when an oil temperature is not lower than the temperature Tp0 [° C.]. Therefore, a duty value at a temperature of not lower than the temperature Tp0 [° C.] is set. The temperature Tp0 will be described later referring to FIG. 22.

The points Pt10, Pt12, and Pt11 illustrated in FIG. 20 respectively indicate duty values checked in Steps S1801, S1802, and S1803 in FIG. 18. Specifically, a duty value at the point Pt10 (an example of the third coordinate) in FIG. 20 is the duty value D040 (an example of the third control value) at the hydraulic pressure P0. A duty value at the point Pt12 (an example of the first coordinate) in FIG. 20 is the duty value D240 (an example of the first control value) at the hydraulic pressure P2. A duty value at the point Pt11 (an example of the second coordinate) in FIG. 20 is the duty value D140 (an example of the second control value) at the hydraulic pressure P1.

A fact that duty values acquired in Steps S1801 to S1803 are indicated in FIG. 20 means that it is judged NO in Step S1710 in FIG. 17. Therefore, a variation (from Dt040 to D040) of duty value indicated by the arrow Ar2 in FIG. 20 exceeds the allowable range "±A [%]".

As illustrated in FIG. 20, a magnitude correlation between the hydraulic pressures P0, P2, Pth, and P1 is P0<P2<Pth<P1. Therefore, the oil jet 71 does not inject oil at the hydraulic pressures P0 and P2, but the oil jet 71 injects oil at the hydraulic pressure P1.

Therefore, a straight line Lt1 (an example of the first initial straight line) connecting the points Pt2 and Pt1, and a straight line Lt11 (an example of the first straight line) passing through the point Pt11 and the point Pt12 represent change characteristics from a state that oil is not injected to a state that oil is injected. Specifically, a tilt angle θ1 (an example of the first initial tilt angle) between the straight line Lt1 and the X-axis, and a tilt angle θ12 (an example of the first tilt angle) between the straight line Lt11 and the X-axis represent a degree of change in duty value from a state that oil is not injected to a state that oil is injected.

A degree of change in duty value from a state that oil is not injected to a state that oil is injected is affected by a viscosity of oil. In other words, a degree of change from the tilt angle θ1 to the tilt angle θ12 represents a change in viscosity of oil.

On the other hand, a straight line Lt0 (an example of the second initial straight line) connecting the points Pt0 and Pt2, and a straight line Lt10 (an example of the second straight line) passing through the points Pt10 and Pt12 represent characteristics in a state that oil is not injected. Specifically, a tilt angle θ0 (an example of the second initial tilt angle) between the straight line LT0 and the X-axis, and a tilt angle θ10 (an example of the second tilt angle) between the straight line Lt10 and the X-axis represent a degree of change in duty value in a state that oil is not injected.

A degree of change in duty value in a state that oil is not injected is not only affected by a viscosity of oil but also affected by engine characteristics. In other words, a degree of change from the tilt angle θ0 to the tilt angle θ10 represents a change in viscosity of oil, and a change in engine characteristics due to changing a hardware component such as the oil control valve 84, for example.

Therefore, (tilt angle θ1/tilt angle θ0), in other words, change characteristics at the arrow Ar1 in FIG. 20 represents only an influence of a viscosity of oil at a point of time when the duty values Dt040, Dt140, and Dt240 are acquired. Further, (tilt angle θ12/tilt angle θ10) represents only an influence of a viscosity of oil at a point of time when the duty values D040, D140, and D240 are acquired.

For example, when a viscosity of oil lowers, a discharge amount of oil for acquiring a same hydraulic pressure increases. Therefore, it is necessary to increase an oil discharge amount from the oil pump 81 in order to retain a target hydraulic pressure. Thus, the controller 60 lowers a duty value to be output to the oil control valve 84.

An operation of the oil jet 71 is alternative, that is, either oil is injected or not injected. Therefore, aging change seldom occurs regarding operation characteristics of the oil jet 71. Thus, it is possible to determine whether or not a viscosity of oil changes by a difference between (tilt angle θ1/tilt angle θ0) and (tilt angle θ12/tilt angle θ10), regardless of whether an elapsed time is long or short.

Note that in FIG. 20, a tilt angle θ11 between a straight line Ltx passing through the point Pt12 and the X-axis satisfies that (tilt angle θ11/tilt angle θ10)=(tilt angle θ1/tilt angle θ0). A fact that a ratio between tilt angles is equal means that a viscosity of oil remains unchanged.

In other words, as long as a viscosity of oil remains unchanged, a duty value Dx corresponding to an intersection between the straight line Ltx and the hydraulic pressure P1 is supposed to be acquired in Step S1803 in FIG. 18. However, in the embodiment, in Step S1803, the duty value D140 larger than the duty value Dx is acquired.

As described above, a fact that a duty value for acquiring a same hydraulic pressure increases means that it is possible to retain a same hydraulic pressure even when an oil discharge amount from the oil pump 81 decreases. In other words, this means that an amount of oil leakage from a clearance of the engine 100 decreases due to an increase in viscosity of oil. The controller 60 determines that a viscosity of oil changes when a difference between (tilt angle θ11/tilt angle θ10) and (tilt angle θ1/tilt angle θ0) is not less than a predetermined value.

Specifically, in Step S1805 in FIG. 18, the controller 60 calculates the tilt angle θ1 from the duty values Dt140 and Dt240, and from the hydraulic pressures P1 and P2. Further, the controller 60 calculates the tilt angle θ0 from the duty values Dt240 and Dt040, and from the hydraulic pressures P2 and P0. The controller 60 calculates (tilt angle θ1/tilt angle θ0). Likewise, the controller 60 calculates (tilt angle θ12/tilt angle θ10). Furthermore, the controller 60 calculates a difference between (tilt angle θ1/tilt angle θ0) and (tilt angle θ12/tilt angle θ10).

The controller 60 determines that a viscosity of oil increases when (tilt angle θ12/tilt angle θ10) increases with respect to (tilt angle θ1/tilt angle θ0) by a predetermined value or more. Further, the controller 60 determines that the viscosity of oil decreases when (tilt angle θ12/tilt angle θ10) decreases with respect to (tilt angle θ1/tilt angle θ0) by a predetermined value or more. The predetermined value is determined in advance, taking into consideration measurement fluctuation of a hydraulic pressure, or the like.

In the case of FIG. 20, the controller 60 determines that a viscosity of oil increases in Step S1805 in FIG. 18.

As described above referring to FIG. 20, the controller 60 determines that a variation of duty value calculated in Step S1709 exceeds the allowable range because a hardware component is changed or because oil is changed. Thus, according to the embodiment, it is possible to determine whether changing a hardware component or changing oil is performed by a user. Further, it is possible to determine whether a viscosity of oil increases or decreases.

Note that as far as a hardware component is not changed, the controller 60 is able to determine whether or not a viscosity of oil has changed only by using a difference between the tilt angle θ1 and the tilt angle θ12.

Referring back to FIG. 18, in Step 1806 following Step S1805, the controller 60 judges whether or not a variation of duty value does not lie within an allowable range because oil is changed.

As is clear from a determination method described referring to FIG. 20 and FIG. 21, the controller 60 is able to determine whether or not a viscosity of oil has changed using the tilt angle θ12 between the straight line Lt11 and the X-axis, the straight line Lt11 connecting the point Pt12 of the duty value D240 at the hydraulic pressure P2 acquired in Step S1802, and the point Pt11 of the duty value D140 at the hydraulic pressure P1 acquired in Step S1803.

Further, as far as a variation of duty value does not lie within an allowable range, and a viscosity of oil remains unchanged, the controller 60 is able to determine that a hardware component is changed.

Further, when a variation of duty value does not lie within an allowable range, and a viscosity of oil has changed, and when a tilt angle, which is acquired by eliminating an influence by a change in viscosity of oil from the tilt angle θ10, has changed from the tilt angle θ0 by a threshold value or more, the threshold value being set by taking into consideration measurement fluctuation or the like, the controller 60 is able to determine that a hardware component is also changed.

As described above, in Step S1806, when a viscosity of oil remains unchanged, the controller 60 judges that a variation of duty value does not lie within an allowable range because a hardware component is changed, and on the other hand, when a viscosity of oil has changed, the controller 60 judges that a variation of duty value does not lie within an allowable range because oil is changed.

When a variation of duty value does not lie within an allowable range because oil is changed (YES in Step S1806), the processing proceeds to Step S1713 in FIG. 17. On the other hand, when a variation of duty value does not lie within an allowable range because a hardware component is changed (NO in Step S1806), in Step S1807, the controller 60 updates the master data 1300 stored in the memory 60*b* with use of an oil temperature, an engine rotational speed, and a duty value acquired when a hydraulic pressure is controlled to the reference hydraulic pressure P0 acquired in Step S1801. Updating the master data is performed in the same manner as in Step S1711 in FIG. 17. By performing Step S1807, changing a hardware component is reflected to the master data 1300 (an example of the second master data).

Next, in Step S1808, the controller 60 updates the determination map 2100 stored in the memory 60*b* with use of an oil temperature and a duty value acquired in Steps S1801 to S1803. By performing Step S1808, changing a hardware component is reflected to the determination map 2100. Thereafter, the processing proceeds to Step S1715 in FIG. 17.

Note that a timing at which the determination map 2100 is updated is not limited to Step S1808. For example, the controller 60 may update the determination map 2100 at a timing at which an oil temperature is equal to the oil temperature of the determination map 2100 by a duty value acquired at the timing, when the hydraulic pressures P0, P1, and P2 are used as a target hydraulic pressure.

Referring back to FIG. 17, in Step S1713, the controller 60 judges whether or not a variation of duty value calculated in Step S1709 lies within the allowable range "−B [%]". When a variation of duty value lies within the allowable range "−B [%]" (YES in Step S1713), the processing proceeds to Step S1714. In Step S1714, the controller 60 changes the activation allowance range of each of the hydraulic actuating devices.

Figure 22:
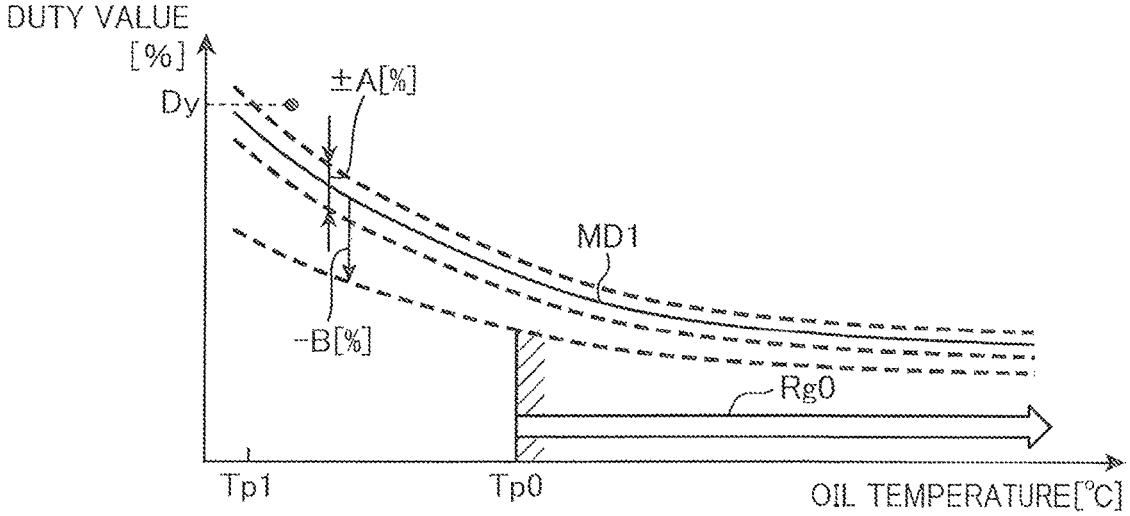
FIG. 22 is a diagram schematically illustrating an activation allowance range set in advance.
Figure 23:
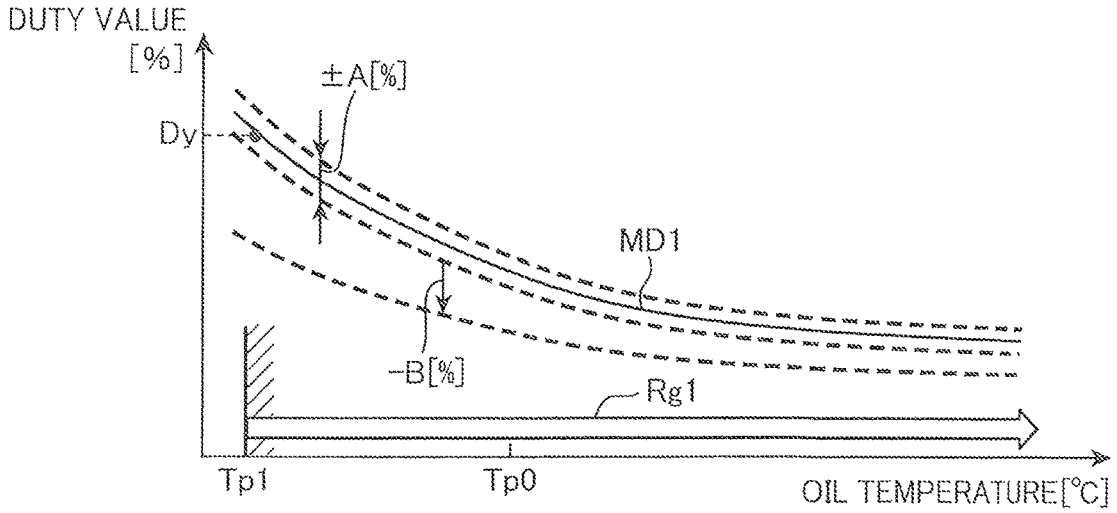
FIG. 23 is a diagram schematically illustrating an activation allowance range which is changed in Step S1714.

FIG. 22 is a diagram schematically illustrating an activation allowance range set in advance. FIG. 23 is a diagram schematically illustrating an activation allowance range changed in Step S1714.

As illustrated in FIG. 22, an activation allowance range Rg0 of each of the hydraulic actuating devices is set in advance to the temperature Tp0 [° C.] or higher. The temperature Tp0 [° C.] is a lowest temperature at which each of the hydraulic actuating devices is activated in a normal state regardless of a viscosity of oil. As illustrated in FIG. 22, when a duty value Dy exceeds the allowable range "±A [%]" (NO in Step S1710 in FIG. 17), a judgment result in Step S1713 is NO regardless of a determination result in Step S1712. Therefore, the processing does not proceed to Step S1714. Thus, the activation allowance range Rg0 of each of the hydraulic actuating devices is retained at the preset temperature Tp0 [° C.] or higher.

On the other hand, as illustrated in FIG. 23, when the duty value Dy lies within the allowable range "±A [%]" (YES in Step S1710 in FIG. 17), the controller 60 extends the allowable range to an activation allowance range Rg1 including the temperature Tp1 [° C.] or higher in Step S1714 in FIG. 17.

When the duty value Dy lies within the allowable range "±A [%]", it is possible to judge that a currently used oil is oil having substantially the same low viscosity as the oil used when master data is corrected in Step S1510 in FIG. 15. Therefore, each of the hydraulic actuating devices is operated in a normal state even when the activation allowance range Rg1 of each of the hydraulic actuating devices is extended to a range including the temperature Tp1 [° C.] or higher.

Referring back to FIG. 17, in Step S1713, when a variation of duty value does not lie within the allowable range "−B [%]" (NO in Step S1713), the processing proceeds to Step S1715. In Step S1715, the controller 60 judges whether or not a variation of duty value is within the activation allowance range of each of the hydraulic actuating devices. When a variation of duty value is within the activation allowance range of each of the hydraulic actuating devices (YES in Step S1715), in Step S1718, the controller 60 issues an activation command to each of the hydraulic actuating devices, and the processing returns to Step S1715. Specifically, when a variation of duty value is within the activation allowance range of a hydraulic actuating device (YES in Step S1715), the processing proceeds to Step S1716, and the controller 60 changes the target hydraulic pressure to a required hydraulic pressure of each of the hydraulic actuating devices. In Step S1717 following Step S1716, the controller 60 confirms that a detected hydraulic pressure of the hydraulic pressure sensor 50*a* coincides with the target hydraulic pressure. Thereafter, the processing proceeds to Step S1718. On the other hand, when a variation of duty value is not within the activation allowance range of each of the hydraulic actuating devices (NO in Step S1715), the controller 60 executes ordinary hydraulic control in Step S1719, and the processing returns to Step S1715.

In FIG. 15, FIG. 17, and FIG. 18, schematic control with respect to each of the hydraulic actuating devices is described. In the following, cylinder deactivation control with respect to the HLAs 45*a* and 46*a* including a valve stopping mechanism among the hydraulic actuating devices is described.

Figure 24:
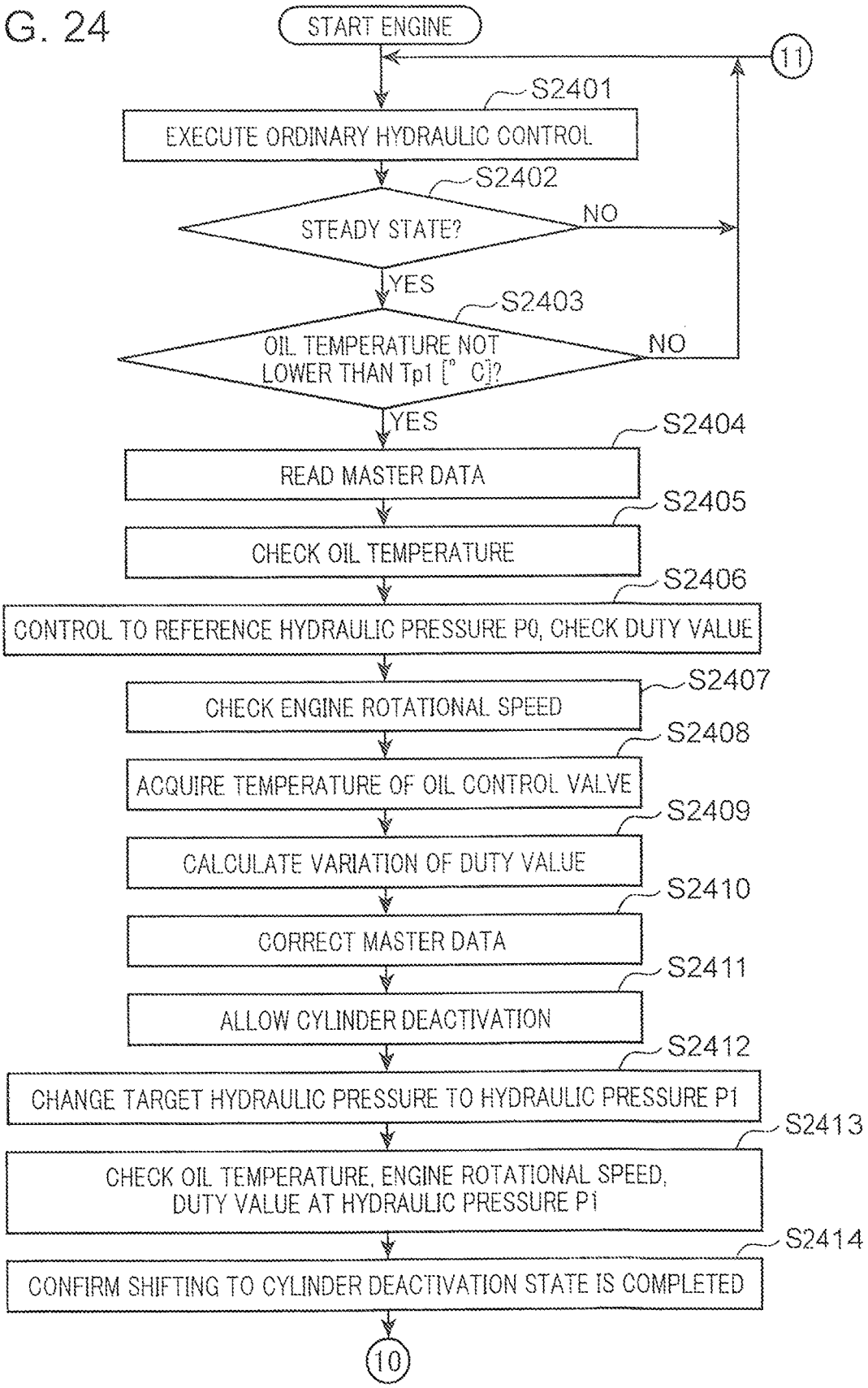
FIG. 24 is a flowchart schematically illustrating an operation of the oil supply control device to be performed when the engine is started for a first time.
Figure 25:
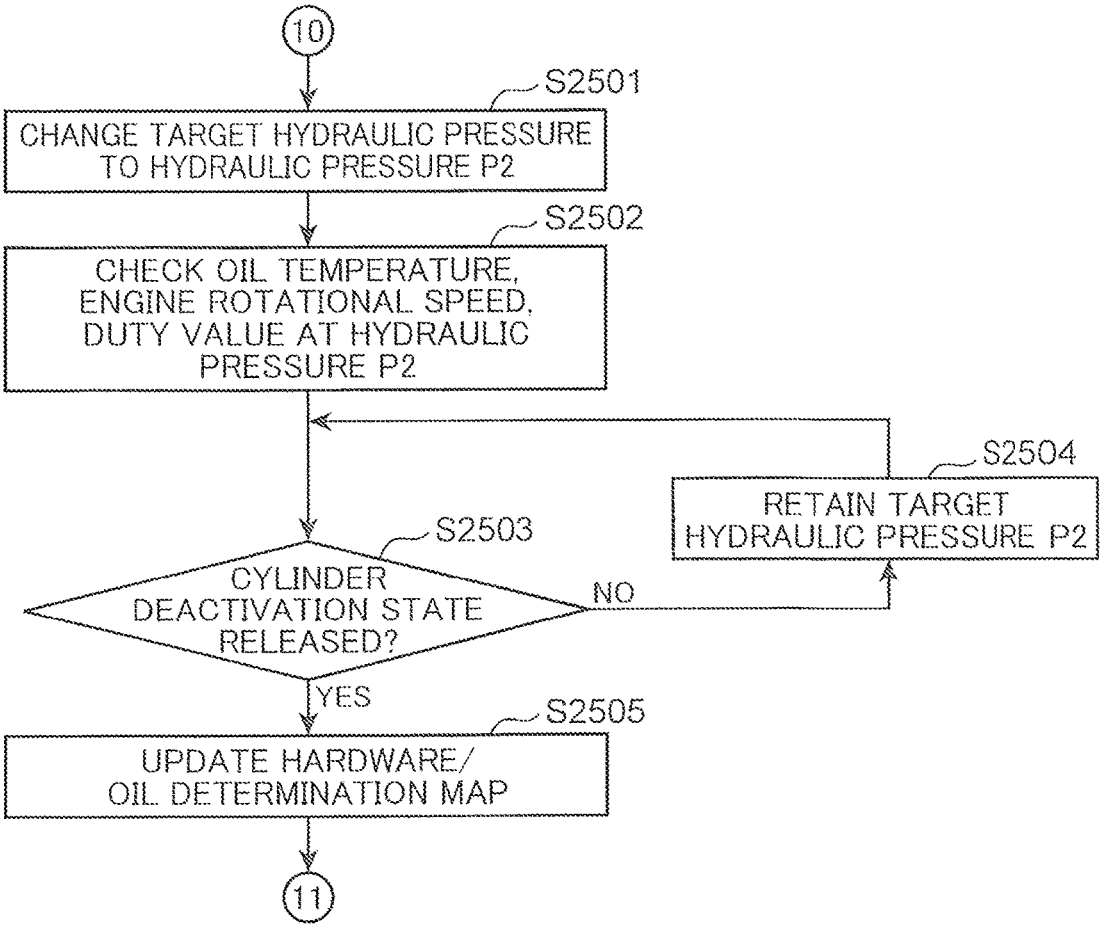
FIG. 25 is a flowchart schematically illustrating the operation of the oil supply control device to be performed when the engine is started for the first time.

FIG. 24 and FIG. 25 are flowcharts schematically illustrating an operation of the oil supply control device 200 to be performed when the engine 100 is started for a first time. The operation of FIG. 24 and FIG. 25 is performed in a final inspection step of a manufacturing process in a factory, for example, and corresponds to the operation illustrated in the flowchart of FIG. 15.

When the engine 100 is started, an operation illustrated in FIG. 24 is started. Steps S2401 and S2402 in FIG. 24 are the same as Steps S1502 and S1503 in FIG. 15.

Next, in Step S2403, the controller 60 judges whether or not an oil temperature detected by the oil temperature sensor 63 is not lower than Tp1 [° C.]. The operation illustrated in FIG. 24 is performed in a factory. Therefore, oil filled in the oil pan 3 is known. In view of the above, the oil temperature Tp1 [° C.] is set in advance to a temperature at which cylinder deactivation is enabled by controlling the HLAs 45*a* and 46*a* including a valve stopping mechanism with use of oil filled in the oil pan 3.

When an oil temperature is lower than Tp1 [° C.] (NO in Step S2403), the processing returns to Step S2401, and ordinary hydraulic control is continued. When an oil temperature is not lower than Tp1 [° C.] (YES in Step S2403), the processing proceeds to Step S2404. Steps S2404 to S2410 are the same as Steps S1504 to S1510 in FIG. 15. By performing Step S2410, the master data 1300 stored in the memory 60*b* is corrected to data, in which individual differences of the engine 100 are reflected.

Next, in Step S2411, the controller 60 allows cylinder deactivation by the HLAs 45*a* and 46*a* including a valve stopping mechanism. In Step S2412 following Step S2411, the controller 60 changes the target hydraulic pressure to the required hydraulic pressure P1 for performing cylinder deactivation. Specifically, the controller 60 controls the HLAs 45*a* and 46*a* including a valve stopping mechanism to shift the engine to a cylinder deactivation state.

Next, in Step S2413, an oil temperature, an engine rotational speed, and a duty value when a detected hydraulic pressure by the hydraulic pressure sensor 50*a* coincides with the target hydraulic pressure P1 are checked. In following Step S2414, the controller 60 confirms that shifting to the cylinder deactivation state is completed.

Subsequently, in Step S2501 in FIG. 25, the controller 60 changes the target hydraulic pressure to the required hydraulic pressure P2 for retaining a cylinder deactivation state. Next, in Step S2502, an oil temperature, an engine rotational speed and a duty value when a detected hydraulic pressure by the hydraulic pressure sensor 50*a* coincides with the target hydraulic pressure P2 are checked. In Step S2503 following Step S2502, the controller 60 judges whether or not the cylinder deactivation state is released.

When the cylinder deactivation state is not released (NO in Step S2503), the controller 60 retains the target hydraulic pressure P2 (Step S2504), and the processing returns to Step S2503. When the cylinder deactivation state is released (YES in Step S2503), the processing proceeds to Step S2505.

In Step S2505, the controller 60 updates the determination map 2100 with use of an oil temperature and a duty value at the hydraulic pressures P0, P1, and P2. According to this configuration, it is possible to acquire the determination map 2100, in which individual differences of each engine 100 are reflected. Thereafter, the processing returns to Step S2401 in FIG. 24.

FIG. 26 to FIG. 30 are flowcharts schematically illustrating an operation of the oil supply control device 200 to be performed when the engine 100 is started at a second time and thereafter. The operation illustrated in FIG. 26 to FIG. 30 corresponds to the operation illustrated in the flowchart of FIG. 17 and FIG. 18.

Steps S2601 and S2602 in FIG. 26 are respectively the same as Steps S1502 and S1503 in FIG. 15. Step S2603 is the same as Step S2403 in FIG. 24. In Step S2603, when an oil temperature is not lower than Tp1 [° C.] (YES in Step S2603), the processing proceeds to Step S2604.

In Step S2604, the controller 60 reads the master data 1300 (FIG. 13) and the activation allowance determination map 1900 (FIG. 19) from the memory 60*b*. The master data 1300 and the master data MD1 of the activation allowance determination map 1900 are master data corrected in Step S2410 in FIG. 24 in a case where the operation is performed when the engine 100 is started at a second time.

Following Steps S2605 to S2609 are respectively the same as Steps S1505 to S1509 in FIG. 15. Following Steps S2610 and S2611 are respectively the same as Steps S1710 and S1711 in FIG. 17. By performing Step S2611, a change in engine characteristics by aging change such as wear is reflected to the master data 1300. Thereafter, in Step S2615, the controller 60 determines whether or not a cylinder deactivation condition is satisfied by an operating state of the engine. When the cylinder deactivation condition is satisfied (YES in Step S2615), in Step S2616 following Step S2615, the controller 60 allows cylinder deactivation. On the other hand, when the cylinder deactivation condition is not satisfied (NO in Step S2615), the processing returns to Step S2601.

In Step S2610, when a variation of duty value calculated in Step S2609 does not lie within the allowable range "±A [%]" (NO in Step S2610), the processing proceeds to Step S2612. When a variation of duty value does not lie within the allowable range "±A [%]", it is presumed that a large change has occurred. Therefore, when it is not possible to determine a cause of the change, the controller 60 cannot proceed the processing to Step S2616, in which cylinder deactivation is allowed.

In Step S2612, the controller 60 judges whether a variation of duty value does not lie within the allowable range "±A [%]" because oil is changed in Step S2802 (FIG. 28) of a previous driving cycle, or the determination of Step S2802 has not been performed in a previous driving cycle. When it is determined that a variation of duty value does not lie within the allowable range "±A [%]" because oil is changed (YES in Step S2612), the processing proceeds to Step S2613. On the other hand, when the determination of Step S2802 has not been performed in a previous driving cycle (NO in Step S2612), the processing proceeds to Step S2614.

In Step S2613, the controller 60 judges whether or not a variation of duty value calculated in Step S2609 lies within the allowable range "−B [%]". When a variation of duty value does not lie within the allowable range "−B [%]" (NO in Step S2613), the processing proceeds to Step S2614.

On the other hand, when a variation of duty value lies within the allowable range "−B [%]" (YES in Step S2613), the processing proceeds to Step S2615. Specifically, if a variation of duty value lies within the allowable range "−B [%]", even when the variation does not lie within the allowable range "±A [%]", it is presumed that a viscosity of oil is significantly low. In this case, the HLAs 45*a* and 46*a* including a valve stopping mechanism can be normally activated. Therefore, the controller 60 proceeds the processing to Step S2615.

In Step S2614, the controller 60 judges whether or not an oil temperature detected by the oil temperature sensor 63 is not lower than Tp0 [° C.]. As described above, the temperature Tp0 [° C.] is a temperature at which each of the hydraulic actuating devices is activated normally regardless of an oil viscosity. In view of the above, when an oil temperature is not lower than Tp0 [° C.] (YES in Step S2614), the processing proceeds to Step S2615. On the other hand, when an oil temperature is lower than Tp0 [° C.] (NO in Step S2614), the processing returns to Step S2601, and the controller 60 executes ordinary hydraulic control without allowing cylinder deactivation.

Figure 27:
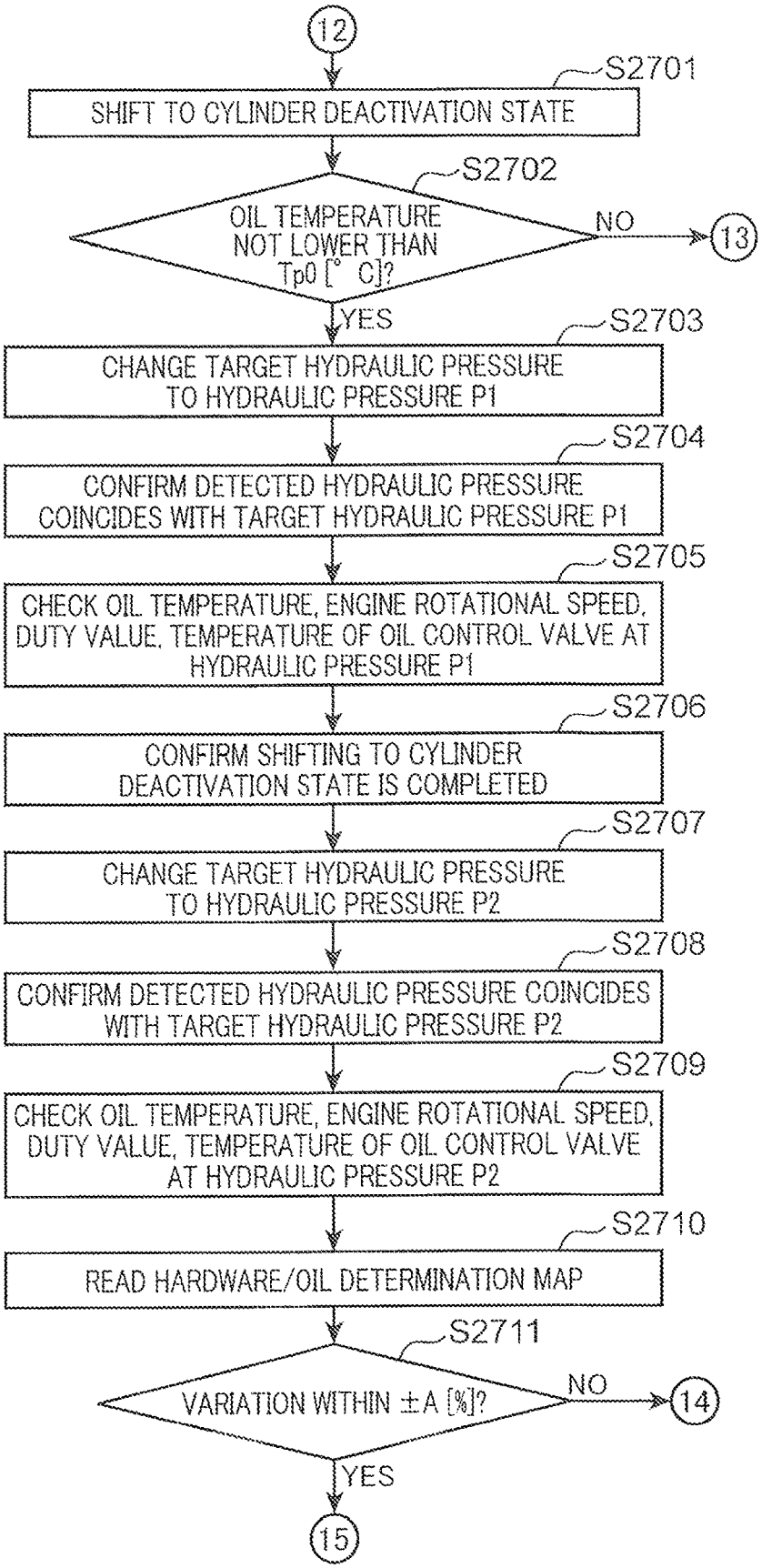
FIG. 27 is a flowchart schematically illustrating the operation of the oil supply control device to be performed when the engine is started at the second time and thereafter.

In Step S2701 in FIG. 27 following Step S2616, the controller 60 controls the HLAs 45*a* and 46*a* including a valve stopping mechanism to shift the engine to a cylinder deactivation state. Specifically, the controller 60 performs the following processing. In Step S2702, the controller 60 judges whether or not an oil temperature detected by the oil temperature sensor 63 is not lower than Tp0 [° C.]. When an oil temperature is not lower than Tp0 [° C.] (YES in Step S2702), the processing proceeds to Step S2703.

In Step S2703, the controller 60 changes the target hydraulic pressure to the hydraulic pressure P1 in order to activate the HLAs 45*a* and 46*a* including a valve stopping mechanism. Next, in Step S2704, the controller 60 checks that a detected hydraulic pressure by the hydraulic pressure sensor 50*a* coincides with the target hydraulic pressure P1.

Next, in Step S2705, the controller 60 checks an oil temperature, an engine rotational speed, a duty value, and a temperature of the oil control valve 84 at the hydraulic pressure P1, and temporarily stores these values in the memory 60*b*. Next, in Step S2706, the controller 60 confirms that shifting to the cylinder deactivation state is completed.

Next, in Step S2707, the controller 60 changes the target hydraulic pressure to the hydraulic pressure P2 in order to retain the cylinder deactivation state. Next, in Step S2708, the controller 60 confirms that a detected hydraulic pressure by the hydraulic pressure sensor 50*a* coincides with the target hydraulic pressure P2.

Next, in Step S2709, the controller 60 checks an oil temperature, an engine rotational speed, a duty value, and a temperature of the oil control valve 84 at the hydraulic pressure P2, and temporarily stores these values in the memory 60*b*. Next, in Step S2710, the controller 60 reads the determination map 2100 stored in the memory 60*b*.

Next, in Step S2711, the controller 60 judges whether or not a variation of duty value lies within the allowable range "±A [%]" in a judgment result of Step S2610. When the variation of duty value does not lie within the allowable range "±A [%]" (NO in Step S2711), the processing proceeds to Step S2801 (FIG. 28).

Figure 28:
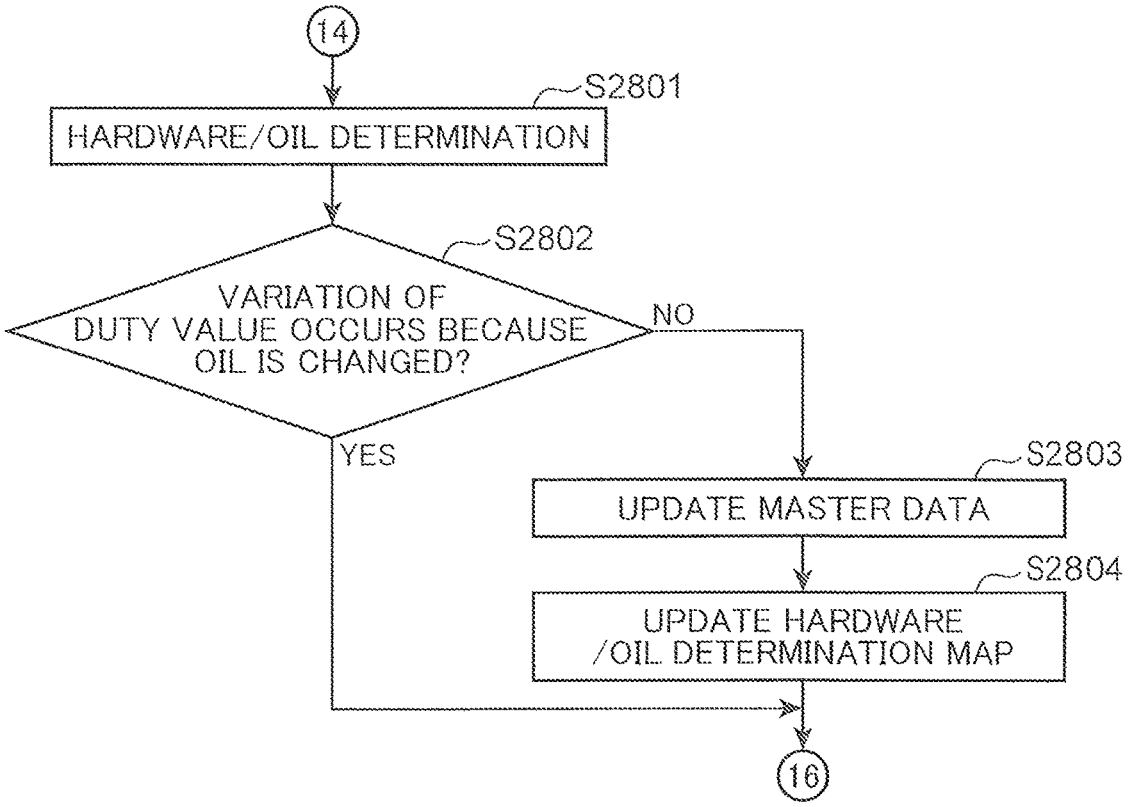
FIG. 28 is a flowchart schematically illustrating the operation of the oil supply control device to be performed when the engine is started at the second time and thereafter.

Step S2801 in FIG. 28 is the same as Step S1805 in FIG. 18. Specifically, in Step S2801, the controller 60 performs determination described referring to FIG. 20. In Step S2801, the controller 60 stores a determination result in the memory 60*b*. The controller 60 uses the determination result of Step S2801, which is stored in the memory 60*b*, in Step S2612 (FIG. 26) of a next driving cycle.

Step S2802 is the same as Step S1806 in FIG. 18. In Step S2802, when a variation of duty value occurs because a hardware component is changed (NO in Step S2802), the processing proceeds to Step S2803. Steps S2803 and S2804 are respectively the same as Steps S1807 and S1808 in FIG. 18.

By performing Steps S2803 and S2804, changing a hardware component is reflected to the master data 1300 and the determination map 2100. Note that the point that a timing at which the determination map 2100 is updated is not limited in Step S2804 is the same as Step S1808 in FIG. 18.

Figure 29:
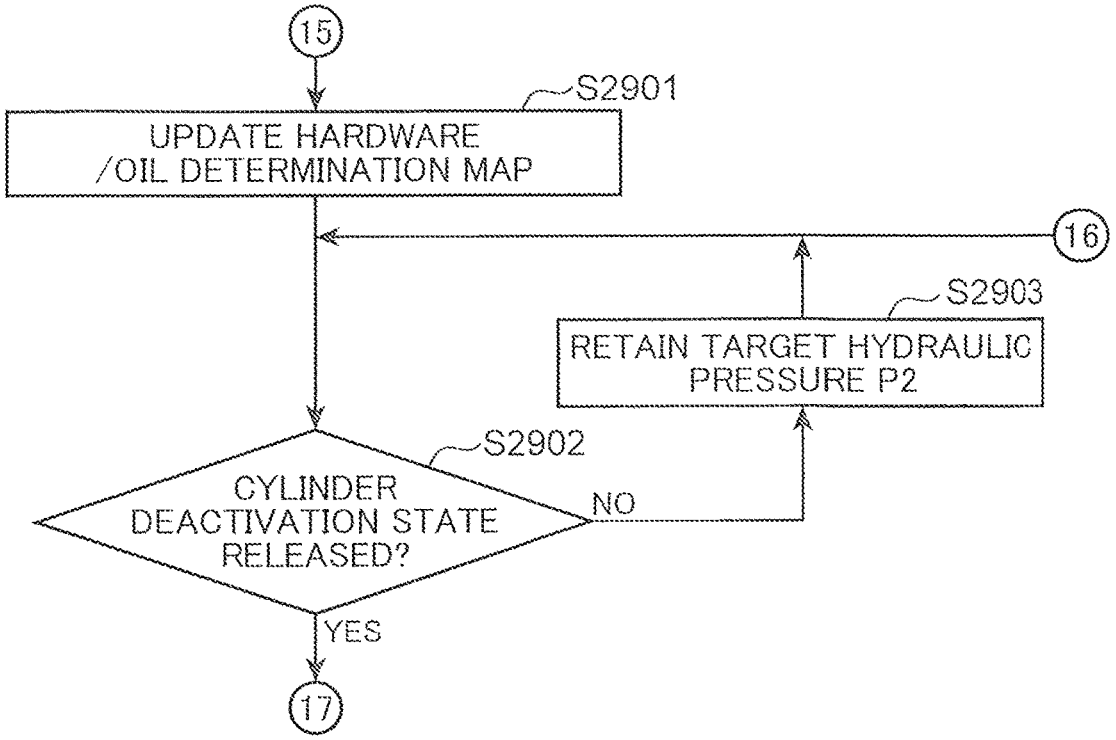
FIG. 29 is a flowchart schematically illustrating the operation of the oil supply control device to be performed when the engine is started at the second time and thereafter.

After Step S2804, the processing proceeds to Step S2902 (FIG. 29). Further, in Step S2802, when a variation of duty value occurs because oil is changed (YES in Step S2802), the processing proceeds to Step S2902 (FIG. 29).

In above Step S2711, when the variation of duty value lies within the allowable "±A [%]" (YES in Step S2711), the processing proceeds to Step S2901 (FIG. 29).

In Step S2901 in FIG. 29, the controller 60 updates the determination map 2100. By performing Step S2901, a change in engine characteristics by aging change such as wear is reflected to the determination map 2100.

In Step S2902 following Step S2901, the controller 60 judges whether or not the cylinder deactivation state is released. When the cylinder deactivation state is not released (NO in Step S2902), the controller 60 retains the target hydraulic pressure P2 (Step S2903), and the processing returns to Step S2902. When the cylinder deactivation state is released (YES in Step S2902), the processing returns to Step S2601 (FIG. 26), and ordinary hydraulic control is executed.

Figure 30:
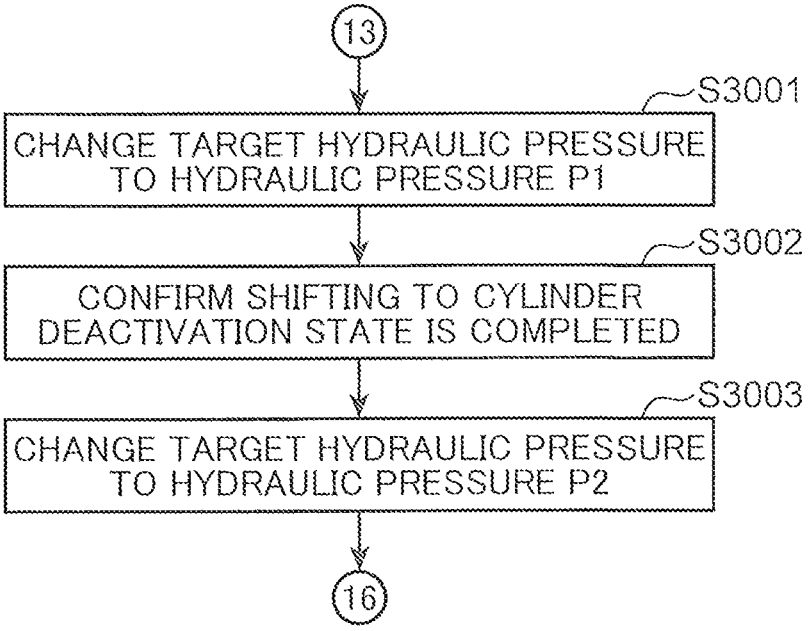
FIG. 30 is a flowchart schematically illustrating the operation of the oil supply control device to be performed when the engine is started at the second time and thereafter.

In Step S2702 in FIG. 27, when an oil temperature is lower than Tp0 [° C.] (NO in Step S2702), the processing proceeds to Step 3001 (FIG. 30). In Step S3001 in FIG. 30, the controller 60 changes the target hydraulic pressure to the hydraulic pressure P1 in order to activate the HLAs 45*a* and 46*a* including a valve stopping mechanism. Next, in Step S3002, the controller 60 confirms that shifting to the cylinder deactivation state is completed. Next, in Step S3003, the controller 60 changes the target hydraulic pressure to the hydraulic pressure P2 in order to retain the cylinder deactivation state. Thereafter, the processing proceeds to Step S2902 (FIG. 29).

When the engine 100 is in a cold state where an oil temperature is lower than Tp0 [° C.], a viscosity of oil is high. Therefore, it may be impossible to acquire a duty value and the like which accurately reflect an engine state. In view of the above, in the embodiment, when an oil temperature is lower than Tp0 [° C.] (NO in Step S2702), the controller 60 performs only cylinder deactivation control, and does not update the determination map 2100. Thus, according to the embodiment, it is possible to accurately update the determination map 2100.

Modified Embodiments (1) In the above embodiment, a capacity variable hydraulic oil pump is used as the oil pump 81. The oil pump 81 may be a pump other than a capacity variable hydraulic oil pump. As the oil pump 81, for example, an electric pump in which an oil discharge amount changes as a rotational speed changes may be used. The oil pump 81 may be a pump in which an oil discharge amount is variable.

(2) In the above embodiment, one master data 1300 is stored in the memory 60*b*. Alternatively, master data for highly viscous oil may be stored in the memory 60*b* in addition to the master data 1300.

(3) In the above embodiment, examples of the hydraulic actuating device include a valve stopping device and a variable valve timing mechanism. Alternatively, a hydraulically operated valve characteristics switching device for changing opening and closing characteristics of an intake valve and an exhaust valve by switching between a plurality of cams may be used.

Note that the aforementioned specific embodiment mainly includes an invention having the following configuration.

An aspect of the present invention includes: an oil pump of which an oil discharge amount is variable; a hydraulic actuating device which is activated in response to a pressure of oil supplied from the oil pump; a hydraulic pressure sensor which is disposed in an oil supply passage connecting the oil pump and the hydraulic actuating device, and detects a hydraulic pressure; an adjusting device which adjusts the oil discharge amount from the oil pump according to an input control value to adjust the hydraulic pressure; a hydraulic controller which outputs the control value to the adjusting device to cause a detected hydraulic pressure detected by the hydraulic pressure sensor to coincide with a target hydraulic pressure depending on an operating state of the engine; a memory which stores in advance a first initial control value and a second initial control value as initial values of the control value corresponding to the target hydraulic pressure; the first initial control value corresponding to a first target hydraulic pressure at which the hydraulic actuating device is not activated, the second initial control value corresponding to a second target hydraulic pressure at which the hydraulic actuating device is activated; and a determination portion which compares oil initial characteristics represented by the first initial control value and the second initial control value stored in advance in the memory with oil characteristics represented by a first control value and a second control value, to perform oil determination as to whether or not a viscosity of the oil has changed, the first control value being a value which is input, when the detected hydraulic pressure is increased from the first target hydraulic pressure to the second target hydraulic pressure, from the hydraulic controller to the adjusting device before increase of the hydraulic pressure, the second control value being a value which is input from the hydraulic controller to the adjusting device after increase of the hydraulic pressure.

In the present aspect, the initial oil characteristics represented by the first initial control value and the second initial control value stored in advance in the memory are acquired. Further, the oil characteristics represented by the first control value and the second control value are acquired, the first control value being a value which is input, when the detected hydraulic pressure is increased from the first target hydraulic pressure to the second target hydraulic pressure, from the hydraulic controller to the adjusting device before increase of the hydraulic pressure, the second control value being a value which is input from the hydraulic controller to the adjusting device after increase of the hydraulic pressure. Then, the initial oil characteristics and the oil characteristics are compared to perform oil determination as to whether a viscosity of oil has changed. Therefore, according to the present aspect, it is possible to determine whether or not a viscosity of oil has changed within a period of time from a point of time when the first initial control value and the second initial control value are acquired until a point of time when the first control value and the second control value are acquired.

In the aforementioned aspect, for example, in an XY coordinate constituted by an X-axis representing the control value and a Y-axis representing the hydraulic pressure, a coordinate corresponding to the first target hydraulic pressure and the first initial control value may be defined as a first initial coordinate, in the XY coordinate, a coordinate corresponding to the second target hydraulic pressure and the second initial control value may be defined as a second initial coordinate, in the XY coordinate, a coordinate corresponding to the first target hydraulic pressure and the first control value may be defined as a first coordinate, in the XY coordinate, a coordinate corresponding to the second target hydraulic pressure and the second control value may be defined as a second coordinate, the oil initial characteristics may be represented by, in the XY coordinate, a first initial tilt angle between a first initial straight line connecting the first initial coordinate and the second initial coordinate, and the X-axis, the oil characteristics may be represented by, in the XY coordinate, a first tilt angle between a first straight line connecting the first coordinate and the second coordinate, and the X-axis, and the determination portion may perform the oil determination using the first initial tilt angle and the first tilt angle.

In the present aspect, the first coordinate and the first initial coordinate are coordinates corresponding to a hydraulic pressure at which the hydraulic actuating device is not activated. The second coordinate and the second initial coordinate are coordinates corresponding to a hydraulic pressure at which the hydraulic actuating device is activated. Therefore, the first initial tilt angle between the first initial straight line connecting the first initial coordinate and the second initial coordinate, and the X-axis, and the first tilt angle between the first straight line connecting the first coordinate and the second coordinate, and the X-axis respectively represent a degree of change in control value when a state is shifted from a state that the hydraulic actuating device is not activated to a state that the hydraulic actuating device is activated.

A degree of change in control value when a state is shifted from a state that the hydraulic actuating device is not activated to a state that the hydraulic actuating device is activated is affected by a viscosity of oil. In other words, a degree of change from the first initial tilt angle to the first tilt angle represents a change in viscosity of oil. Therefore, according to the present aspect, it is possible to determine whether or not a viscosity of oil has changed using the first initial tilt angle and the first tilt angle.

In the aforementioned aspect, for example, the memory may further store in advance a third initial control value corresponding to a third target hydraulic pressure lower than the first target hydraulic pressure, as an initial value of the control value corresponding to the target hydraulic pressure, the hydraulic controller may input a third control value to the adjusting device when the detected hydraulic pressure coincides with the third target hydraulic pressure, in the XY coordinate, a coordinate corresponding to the third target hydraulic pressure and the third initial control value may be defined as a third initial coordinate, in the XY coordinate, a coordinate corresponding to the third target hydraulic pressure and the third control value may be defined as a third coordinate, in the XY coordinate, an angle between a second initial straight line connecting the first initial coordinate and the third initial coordinate, and the X-axis may be defined as a second initial tilt angle, in the XY coordinate, an angle between a second straight line connecting the first coordinate and the third coordinate, and the X-axis may be defined as a second tilt angle, and the determination portion may determine that a viscosity of the oil has changed when a difference between (the first initial tilt angle/the second initial tilt angle) and (the first tilt angle/the second tilt angle) is not less than a predetermined value.

In the present aspect, the third coordinate and the third initial coordinate are coordinates corresponding to a hydraulic pressure at which the hydraulic actuating device is not activated. Therefore, the second initial tilt angle between the second initial straight line connecting the first initial coordinate and the third initial coordinate, and the X-axis, and the second tilt angle between the second straight line connecting the first coordinate and the third coordinate, and the X-axis respectively represent a degree of change in control value in a state that the hydraulic actuating device is not activated.

A degree of change in control value in a state that the hydraulic actuating device is not activated is not only affected by a viscosity of oil but also affected by engine characteristics. In other words, a degree of change from the second initial tilt angle to the second tilt angle represents a change in viscosity of oil, and a change in engine characteristics due to changing a hardware component such as an engine component.

Therefore, (the first initial tilt angle/the second initial tilt angle) represents only an influence of a viscosity of oil at a point of time when the first initial control value, the second initial control value, and the third initial control value are acquired. Further, (the first tilt angle/the second tilt angle) represents only an influence of a viscosity of oil at a point of time when the first control value, the second control value, and the third control value are acquired.

Consequently, when a difference between (the first initial tilt angle/the second initial tilt angle) and (the first tilt angle/the second tilt angle) is not less than the predetermined value, it is determined that a viscosity of oil has changed. Accordingly, it becomes possible to determine whether or not a viscosity of oil has changed.

In the aforementioned aspect, the determination portion may determine that a viscosity of oil has increased, when (the first tilt angle/the second tilt angle) is increased with respect to (the first initial tilt angle/the second initial tilt angle) by a predetermined value or more. Alternatively, the determination portion may determine that a viscosity of oil has lowered, when (the first tilt angle/the second tilt angle) is decreased with respect to (the first initial tilt angle/the second initial tilt angle) by a predetermined value or more.

In the aforementioned aspect, for example, the determination portion may further determine whether or not a difference between the third initial control value and the third control value lies within a predetermined allowable range, the determination portion may perform the oil determination when it is determined that the difference does not lie within the allowable range, and the determination portion may store the first control value in the memory as the first initial control value, may store the second control value in the memory as the second initial control value, and may store the third control value in the memory as the third initial control value, when it is determined that a viscosity of the oil has not changed.

In the present aspect, a fact that a difference between the third initial control value and the third control value does not lie within a predetermined allowable range, and a viscosity of oil remains unchanged means that the difference between the third initial control value and the third control value does not lie within the allowable range because engine characteristics have greatly changed due to changing a hardware component such as an engine component.

In view of the above, in the present aspect, the first control value is stored in the memory as the first initial control value, the second control value is stored in the memory as the second initial control value, and the third control value is stored in the memory as the third initial control value. Specifically, the respective initial control values stored in the memory are updated.

Therefore, in the oil determination after updating, the respective updated initial control values are used. Consequently, according to the present aspect, even when a hardware component such as an engine component is changed, it is possible to perform the oil determination without being affected by a change of a hardware component.

In the aforementioned aspect, for example, the hydraulic actuating device may be an oil jet which injects the oil at a hydraulic pressure not lower than a hydraulic pressure threshold value which is higher than the first target hydraulic pressure and lower than the second target hydraulic pressure.

In the present aspect, an operation of the oil jet is an operation that either oil is injected or not. Thus, aging change is small in the operation of the oil jet. Therefore, a difference between (the first initial tilt angle/the second initial tilt angle) and (the first tilt angle/the second tilt angle) represents a change in viscosity of oil, even when a time lapses. Consequently, according to the present aspect, it is possible to determine whether or not a viscosity of oil has changed without depending on aging change.

In the aforementioned aspect, for example, the oil supply control device for an engine may further include a valve stopping device which releases, by a hydraulic pressure, a lock mechanism for holding a support mechanism that supports a swing arm of an intake valve or an exhaust valve to be activated by a cam of a camshaft, to stop activation of the intake valve or the exhaust valve to open.

According to the present aspect, it is possible to appropriately activate the valve stopping device, regardless of whether or not a viscosity of oil has changed.

The invention claimed is:

1. An oil supply control device for an engine, comprising:

an oil pump of which an oil discharge amount is variable;

a hydraulic actuating device which is activated in response to a pressure of oil supplied from the oil pump;

a hydraulic pressure sensor which is disposed in an oil supply passage connecting the oil pump and the hydraulic actuating device, and detects a hydraulic pressure;

an adjusting device which adjusts the oil discharge amount from the oil pump according to an input control value to adjust the hydraulic pressure;

a hydraulic controller which outputs the control value to the adjusting device to cause a detected hydraulic pressure detected by the hydraulic pressure sensor to coincide with a target hydraulic pressure depending on an operating state of the engine;

a memory which stores in advance a first initial control value and a second initial control value as initial values of the control value corresponding to the target hydraulic pressure; the first initial control value corresponding to a first target hydraulic pressure at which the hydraulic actuating device is not activated, the second initial control value corresponding to a second target hydraulic pressure at which the hydraulic actuating device is activated; and a determination portion which compares oil initial characteristics represented by the first initial control value and the second initial control value stored in advance in the memory with oil characteristics represented by a first control value and a second control value, to perform oil determination as to whether or not a viscosity of the oil has changed, the first control value being a value which is input, when the detected hydraulic pressure is increased from the first target hydraulic pressure to the second target hydraulic pressure, from the hydraulic controller to the adjusting device before increase of the hydraulic pressure, the second control value being a value which is input from the hydraulic controller to the adjusting device after increase of the hydraulic pressure.

2. The oil supply control device for an engine according to claim 1, wherein in an XY coordinate constituted by an X-axis representing the control value and a Y-axis representing the hydraulic pressure, a coordinate corresponding to the first target hydraulic pressure and the first initial control value is defined as a first initial coordinate, in the XY coordinate, a coordinate corresponding to the second target hydraulic pressure and the second initial control value is defined as a second initial coordinate, in the XY coordinate, a coordinate corresponding to the first target hydraulic pressure and the first control value is defined as a first coordinate, in the XY coordinate, a coordinate corresponding to the second target hydraulic pressure and the second control value is defined as a second coordinate, the oil initial characteristics are represented by, in the XY coordinate, a first initial tilt angle between a first initial straight line connecting the first initial coordinate and the second initial coordinate, and the X-axis, the oil characteristics are represented by, in the XY coordinate, a first tilt angle between a first straight line connecting the first coordinate and the second coordinate, and the X-axis, and the determination portion performs the oil determination using the first initial tilt angle and the first tilt angle.

3. The oil supply control device for an engine according to claim 2, wherein the memory further stores in advance a third initial control value corresponding to a third target hydraulic pressure lower than the first target hydraulic pressure, as an initial value of the control value corresponding to the target hydraulic pressure, the hydraulic controller inputs a third control value to the adjusting device when the detected hydraulic pressure coincides with the third target hydraulic pressure, in the XY coordinate, a coordinate corresponding to the third target hydraulic pressure and the third initial control value is defined as a third initial coordinate, in the XY coordinate, a coordinate corresponding to the third target hydraulic pressure and the third control value is defined as a third coordinate, in the XY coordinate, an angle between a second initial straight line connecting the first initial coordinate and the third initial coordinate, and the X-axis is defined as a second initial tilt angle, in the XY coordinate, an angle between a second straight line connecting the first coordinate and the third coordinate, and the X-axis is defined as a second tilt angle, and the determination portion determines that a viscosity of the oil has changed when a difference between (the first initial tilt angle/the second initial tilt angle) and (the first tilt angle/the second tilt angle) is not less than a predetermined value.

4. The oil supply control device for an engine according to claim 3, wherein the determination portion further determines whether or not a difference between the third initial control value and the third control value lies within a predetermined allowable range, the determination portion performs the oil determination when it is determined that the difference does not lie within the allowable range, and the determination portion stores the first control value in the memory as the first initial control value, stores the second control value in the memory as the second initial control value, and stores the third control value in the memory as the third initial control value, when it is determined that a viscosity of the oil has not changed.

5. The oil supply control device for an engine according to claim 3, wherein the hydraulic actuating device is an oil jet which injects the oil at a hydraulic pressure not lower than a hydraulic pressure threshold value which is higher than the first target hydraulic pressure and lower than the second target hydraulic pressure.

6. The oil supply control device for an engine according to claim 1, further comprising:

a valve stopping device which releases, by a hydraulic pressure, a lock mechanism for holding a support mechanism that supports a swing arm of an intake valve or an exhaust valve to be activated by a cam of a camshaft, to stop activation of the intake valve or the exhaust valve to open.

* * * * *